US011470978B2

(12) United States Patent
Soreefan et al.

(10) Patent No.: US 11,470,978 B2
(45) **Date of Patent: *Oct. 18, 2022**

(54) OBLIQUE HINGED PANELS AND BLADDER APPARATUS FOR SLEEP DISORDERS

(71) Applicant: Hill-Rom Services, Inc., Batesville, IN (US)

(72) Inventors: Ibne Soreefan, West Chester, OH (US); David L. Ribble, Batesville, IN (US); Kirsten M. Emmons, Batesville, IN (US); Craig M. Meyerson, Syracuse, NY (US); David Quinn, Auburn, NY (US); Thomas F. Heil, Batesville, IN (US)

(73) Assignee: Hill-Rom Services, Inc., Batesville, IN (US)

( * ) Notice: Subject to any disclaimer, the term of this patent is extended or adjusted under 35 U.S.C. 154(b) by 56 days.

This patent is subject to a terminal disclaimer.

(21) Appl. No.: 17/191,884

(22) Filed: Mar. 4, 2021

(65) Prior Publication Data

US 2021/0186222 A1 Jun. 24, 2021

Related U.S. Application Data

(63) Continuation of application No. 16/787,331, filed on Feb. 11, 2020, now Pat. No. 10,959,534.

(60) Provisional application No. 62/811,605, filed on Feb. 28, 2019.

(51) Int. Cl.
*A47C 20/04* (2006.01)
*A47C 19/02* (2006.01)

(52) U.S. Cl.
CPC ..... *A47C 20/048* (2013.01); *A47C 19/022* (2013.01); *A47C 19/025* (2013.01); *A47C 20/04* (2013.01)

(58) Field of Classification Search
CPC ..... A47C 20/048; A47C 20/04; A47C 19/027; A47C 19/025
USPC ..... 5/659, 660, 658, 615, 614
See application file for complete search history.

(56) References Cited

U.S. PATENT DOCUMENTS

| | | | | |
|---|---|---|---|---|
| 948,644 | A | 2/1910 | Bjornstad | |
| 1,610,898 | A | 12/1926 | Steiner | |
| 2,612,645 | A | 10/1952 | Boland | |
| 2,769,182 | A * | 11/1956 | Nunlist | A61G 7/1021 5/660 |

(Continued)

FOREIGN PATENT DOCUMENTS

| | | | |
|---|---|---|---|
| DE | 1987293 A1 | 6/1968 | |
| DE | 3418072 A1 * | 11/1985 | A47C 19/045 |

(Continued)

OTHER PUBLICATIONS

Adesanya, Adebola O., et al., Perioperative Management of Obstructive Sleep Apnea, CHEST/138/6, Dec. 2010 (10 pages).

(Continued)

*Primary Examiner* — Robert G Santos
(74) *Attorney, Agent, or Firm* — Barnes & Thornburg LLP

(57) ABSTRACT

A head elevation apparatus configured to be positioned under a mattress may include a base panel and a top panel positioned on the base panel. The top panel may include a center panel hingedly coupled to the base panel. An upper flap may be hingedly coupled to the center panel. A lower flap may be hingedly coupled to the center panel.

17 Claims, 6 Drawing Sheets

(56) References Cited

U.S. PATENT DOCUMENTS 2,887,692 A 5/1959 Berveir
3,392,412 A 7/1968 Aymar
3,392,723 A * 7/1968 Calvin ..... A47C 21/006 601/41
3,426,373 A 2/1969 Scott et al.
3,606,623 A 9/1971 Aymar et al.
3,636,573 A * 1/1972 Bartz ..... A61G 7/015 5/660
3,667,075 A 6/1972 Ballard
3,775,785 A 12/1973 Mittendorf
3,781,928 A 1/1974 Swallert
4,127,906 A * 12/1978 Zur ..... A61G 7/02 297/DIG. 10
4,142,263 A 3/1979 Pierson
4,150,284 A 4/1979 Trenkler et al.
4,151,407 A 4/1979 Delagi et al.
4,165,125 A 8/1979 Owen
4,183,015 A 1/1980 Drew et al.
4,216,462 A 8/1980 Digiacomo et al.
4,225,953 A 9/1980 Simon et al.
4,225,988 A * 10/1980 Cary ..... A61G 7/015 5/942
4,228,426 A 10/1980 Roberts
4,237,344 A 12/1980 Moore
4,287,620 A * 9/1981 Zur ..... A61G 7/015 5/942
4,298,863 A 11/1981 Natitus et al.
4,309,783 A 1/1982 Cammack et al.
4,331,953 A 5/1982 Blevins et al.
4,527,298 A 7/1985 Moulton
4,542,547 A 9/1985 Sato
4,554,693 A 11/1985 Calloway
4,577,185 A 3/1986 Andersen
4,578,671 A 3/1986 Flowers
4,593,273 A 6/1986 Narcisse
4,598,275 A 7/1986 Ross et al.
4,601,064 A 7/1986 Shipley
4,625,348 A * 12/1986 Renggli ..... A47C 20/048 5/618
4,649,385 A 3/1987 Aires et al.
4,680,790 A 7/1987 Packard et al.
4,754,510 A 7/1988 King
4,807,313 A 2/1989 Ryder et al.
4,814,751 A 3/1989 Hawkins et al.
4,839,932 A 6/1989 Williamson
4,841,221 A 6/1989 Barney et al.
4,850,040 A 7/1989 Teich et al.
4,873,731 A * 10/1989 Williamson ..... A61G 7/002 5/618
4,877,288 A 10/1989 Lee
4,932,089 A 6/1990 Laviero
4,935,968 A * 6/1990 Hunt ..... A61G 7/05776 5/713
4,955,000 A 9/1990 Nastrom
4,967,195 A 10/1990 Shipley
4,990,892 A 2/1991 Guest et al.
4,998,095 A 3/1991 Shields
4,998,939 A 3/1991 Potthast et al.
5,012,539 A 5/1991 Grigg
5,036,852 A 8/1991 Leishman
5,060,174 A 10/1991 Gross
5,062,151 A 10/1991 Shipley
5,065,154 A 11/1991 Kaiser et al.
5,086,290 A 2/1992 Murray et al.
5,092,007 A 3/1992 Hasty
5,097,551 A 3/1992 Smith
5,103,108 A 4/1992 Crimmins
5,124,991 A 6/1992 Allen
5,137,033 A 8/1992 Norton
5,144,284 A 9/1992 Hammett
5,153,584 A 10/1992 Engira
5,170,522 A 12/1992 Walker
5,181,288 A * 1/1993 Heaton ..... A61G 7/05769 5/607
5,184,112 A 2/1993 Gusakov
5,195,198 A 3/1993 Travis
5,253,656 A 10/1993 Rincoe et al.
5,269,388 A 12/1993 Reichow et al.
5,276,432 A 1/1994 Travis
5,311,625 A 5/1994 Barker et al.
5,345,630 A 9/1994 Healy
5,353,012 A 10/1994 Barham et al.
5,415,167 A 5/1995 Wilk
5,425,150 A * 6/1995 Palmer, Jr. ..... A47C 20/048 5/634
5,432,967 A 7/1995 Raftery
5,490,295 A 2/1996 Boyd
5,500,964 A * 3/1996 Bergersen ..... A61G 7/001 5/607
5,528,783 A 6/1996 Kunz et al.
5,577,278 A 11/1996 Barker et al.
5,611,096 A 3/1997 Bartlett et al.
5,621,931 A 4/1997 Hamilton
5,715,548 A 2/1998 Weismiller et al.
5,745,937 A 5/1998 Weismiller et al.
5,754,998 A 5/1998 Selton
5,806,115 A * 9/1998 Brown ..... A47C 31/008 297/DIG. 8
5,838,223 A 11/1998 Gallant et al.
5,844,488 A 12/1998 Musick
5,867,821 A 2/1999 Ballantyne et al.
5,877,675 A 3/1999 Rebstock et al.
5,910,080 A 6/1999 Selton
5,933,488 A 8/1999 Marcus et al.
5,936,539 A 8/1999 Fuchs
5,942,986 A 8/1999 Shabot et al.
5,944,659 A 8/1999 Flach et al.
5,963,137 A 10/1999 Waters
5,966,762 A 10/1999 Wu
6,009,873 A 1/2000 Neviaser
6,012,186 A * 1/2000 Soltani ..... A47C 31/008 5/613
6,047,419 A 4/2000 Ferguson
6,081,950 A 7/2000 Selton
6,093,146 A 7/2000 Filangeri
6,097,308 A 8/2000 Albert et al.
6,111,509 A 8/2000 Holmes
6,125,350 A 9/2000 Dirbas
6,131,219 A 10/2000 Roberts
6,133,837 A 10/2000 Riley
6,142,592 A 11/2000 Grittke et al.
6,154,900 A 12/2000 Shaw
6,163,903 A 12/2000 Weismiller et al.
6,183,417 B1 2/2001 Geheb et al.
6,208,250 B1 3/2001 Dixon et al.
D446,676 S 8/2001 Mayes
6,370,716 B1 4/2002 Wilkinson
6,397,416 B2 6/2002 Brooke et al.
6,485,441 B2 11/2002 Woodward
6,536,056 B1 3/2003 Vizalik et al.
6,671,900 B2 * 1/2004 Davis ..... A47C 20/08 5/118
6,671,907 B1 1/2004 Zuberi
6,681,424 B1 1/2004 Bourgraf et al.
6,681,425 B2 * 1/2004 Leventhal ..... A47C 20/048 5/660
6,684,425 B2 2/2004 Davis
6,715,172 B2 * 4/2004 Leventhal ..... A47C 20/048 5/660
6,739,005 B2 * 5/2004 Davis ..... A47C 20/048 5/613
6,751,817 B1 6/2004 Leach
6,904,631 B2 6/2005 Vizalik et al.
7,007,327 B2 3/2006 Ogawa et al.
7,017,213 B2 3/2006 Chisari
7,089,615 B1 8/2006 Parimuha
D527,937 S 9/2006 Aiken et al.
7,154,397 B2 12/2006 Zerhusen et al.
7,346,945 B2 3/2008 Phillips et al.
7,418,751 B1 9/2008 Bartlett et al.
7,464,422 B2 12/2008 Townsend
7,513,003 B2 4/2009 Mossbeck

(56) References Cited

U.S. PATENT DOCUMENTS

| | | | | |
|---|---|---|---|---|
| 7,568,246 | B2 | 8/2009 | Weismiller et al. | |
| 7,654,974 | B2 | 2/2010 | Bass | |
| 7,669,263 | B2 | 3/2010 | Menkedick et al. | |
| 7,690,059 | B2 | 4/2010 | Lemire et al. | |
| 7,805,784 | B2 | 10/2010 | Lemire et al. | |
| 7,852,208 | B2 | 12/2010 | Collins, Jr. et al. | |
| 7,861,334 | B2 | 1/2011 | Lemire et al. | |
| 7,886,379 | B2 | 2/2011 | Benzo et al. | |
| 7,962,981 | B2 | 6/2011 | Lemire et al. | |
| 7,975,335 | B2 | 7/2011 | O'Keefe et al. | |
| 8,006,332 | B2 | 8/2011 | Lemire et al. | |
| 8,220,091 | B2 | 7/2012 | Schultz | |
| 8,261,380 | B2 | 9/2012 | Ferraresi et al. | |
| 8,356,602 | B2 | 1/2013 | Crocetti | |
| 8,393,026 | B2 | 3/2013 | Dionne et al. | |
| 8,413,271 | B2 | 4/2013 | Blanchard et al. | |
| 8,536,990 | B2 | 9/2013 | Collins, Jr. et al. | |
| 8,544,126 | B2 | 10/2013 | Elliott et al. | |
| 8,656,541 | B2 | 2/2014 | Muollo | |
| 8,661,586 | B2 | 3/2014 | Melcher et al. | |
| 8,689,376 | B2 | 4/2014 | Becker et al. | |
| 8,695,134 | B2 | 4/2014 | Schultz | |
| 8,701,229 | B2 | 4/2014 | Lemire et al. | |
| 8,720,447 | B2 | 5/2014 | North | |
| 8,756,736 | B1 | 6/2014 | Minson | |
| 8,789,222 | B2 | 7/2014 | Blanchard et al. | |
| 8,789,224 | B2 | 7/2014 | Wyatt et al. | |
| 8,832,887 | B2 | 9/2014 | Mossbeck | |
| 8,844,076 | B2 | 9/2014 | Becker et al. | |
| 8,870,764 | B2 | 10/2014 | Rubin | |
| 9,038,217 | B2 | 5/2015 | Elliot et al. | |
| 9,126,571 | B2 | 9/2015 | Lemire et al. | |
| 10,959,534 | B2 * | 3/2021 | Soreefan | A47C 19/025 |
| 2001/0044959 | A1 * | 11/2001 | Davis | B60N 2/39 5/118 |
| 2003/0041378 | A1 | 3/2003 | Davis | |
| 2003/0150058 | A1 | 8/2003 | Davis | |
| 2003/0188386 | A1 * | 10/2003 | Leventhal | A47C 20/048 5/660 |
| 2003/0188387 | A1 * | 10/2003 | Leventhal | A47C 20/048 5/660 |
| 2003/0196270 | A1 | 10/2003 | Leventhal et al. | |
| 2006/0117482 | A1 | 6/2006 | Branson | |
| 2006/0123550 | A1 | 6/2006 | Davis | |
| 2006/0179580 | A1 | 8/2006 | Robertson et al. | |
| 2006/0230539 | A1 | 10/2006 | Goodman | |
| 2007/0163051 | A1 | 7/2007 | Straub | |
| 2008/0109965 | A1 | 5/2008 | Mossbeck | |
| 2008/0147442 | A1 | 6/2008 | Warner et al. | |
| 2008/0148487 | A1 | 6/2008 | Lord et al. | |
| 2009/0250070 | A1 | 10/2009 | Pfeifer | |
| 2010/0138998 | A1 | 6/2010 | Wilkinson et al. | |
| 2011/0231996 | A1 | 9/2011 | Lemire et al. | |
| 2012/0222214 | A1 | 9/2012 | Lachenbruch et al. | |
| 2013/0245395 | A1 | 9/2013 | Bidarian Moniri | |
| 2014/0059768 | A1 | 3/2014 | Lemire et al. | |
| 2014/0088373 | A1 | 3/2014 | Phillips et al. | |
| 2014/0173829 | A1 | 6/2014 | Melcher et al. | |
| 2014/0180036 | A1 | 6/2014 | Bukkapatnam et al. | |
| 2014/0245539 | A1 | 9/2014 | Ooba | |
| 2014/0259417 | A1 | 9/2014 | Nunn et al. | |
| 2014/0259418 | A1 | 9/2014 | Nunn et al. | |
| 2014/0259419 | A1 | 9/2014 | Stusynski et al. | |
| 2014/0259433 | A1 | 9/2014 | Nunn et al. | |
| 2014/0259434 | A1 | 9/2014 | Nunn et al. | |
| 2014/0266733 | A1 | 9/2014 | Hayes et al. | |
| 2014/0277611 | A1 | 9/2014 | Nunn et al. | |
| 2014/0277822 | A1 | 9/2014 | Nunn et al. | |
| 2014/0283302 | A1 | 9/2014 | Horstmann | |
| 2015/0000035 | A1 | 1/2015 | Becker et al. | |
| 2016/0331616 | A1 | 11/2016 | Fisk et al. | |
| 2018/0333082 | A1 | 11/2018 | Hoffman et al. | |
| 2020/0275784 | A1 * | 9/2020 | Soreefan | A47C 20/048 |
| 2021/0186222 | A1 * | 6/2021 | Soreefan | A61G 7/0573 |

FOREIGN PATENT DOCUMENTS

| | | | | |
|---|---|---|---|---|
| DE | 4137631 | A1 | 5/1992 | |
| EP | 0262771 | A1 | 4/1988 | |
| EP | 2140847 | A2 | 1/2010 | |
| EP | 2175822 | A1 | 4/2010 | |
| EP | 2494946 | A2 | 9/2012 | |
| EP | 3701925 | A1 * | 9/2020 | A47C 19/022 |
| JP | S5438512 | U | 3/1979 | |
| JP | H01238859 | A | 9/1989 | |
| JP | H04297257 | A | 10/1992 | |
| JP | 2011143237 | A | 7/2011 | |
| KR | 20110083167 | A | 7/2011 | |
| WO | 2010048310 | A1 | 4/2010 | |
| WO | 2013031504 | A1 | 7/2013 | |
| WO | 2013134638 | A1 | 9/2013 | |
| WO | 2013166003 | A1 | 11/2013 | |
| WO | 2014069713 | A1 | 5/2014 | |
| WO | 2014117128 | A1 | 7/2014 | |
| WO | 2014151707 | A1 | 9/2014 | |
| WO | 2014152891 | A1 | 9/2014 | |

OTHER PUBLICATIONS

Ankichetty, Saravanan and Frances Chung, Considerations for Patients with Obstructive Sleep Apnea Undergoing Ambulatory Surgery, Current O inion in Anesthesiology 2011, 24:605-611 (7 pages).

Arnold, Donald H., et al., Estimation of Airway Obstruction Using Oximeter Plethysmograph Waveform Data, Respiratory Research 2005, 6:65 (8 pages).

American Society of Anesthesiologists, Inc., Practice Guidelines for the Perioperative Management of Patients with Obstructive Sleep Apnea, Anesthesiology 2006, V. 104, 1081-93, No. 5, May 2006, (13 pages).

Benumof, Jonathan L., Obstructive Sleep Apnea in the Adult Obese Patient: Implications for Airway Management, Journal of Clinical Anesthesia 13:144-156, 2001 (13 pages).

Berend, Keith R., et al., Prevalence and Management of Obstructive Sleep Apnea in Patients Undergoing Total Joint Arthroolastv. The Journal of Arthroplastv vol. 25 No. 6 Suppl. 1 2010 (4 pages).

Berger, G., et al., Progression of Snoring and Obstructive Sleep Apnoea: The Role of Increasing Weight and Time, European Respiratory Journal, vol. 33, No. 2, 2009 (8 pages).

Bianchi, Matt T., Screening for Obstructive Sleep Apnea: Bayes Weighs In, The Open Sleep Hournal, 2009, 2, 56-59 (4 pages).

Bignold, James J., et al., Accurate Position Monitoring and Improved Supine-Dependent Obstructive Sleep Apnea with a New Position Recording and Supine Avoidance Device, Journal of Clinical Sleep Medicine. vol. 7. No. 4. 2001 (8 pages).

Bloom, Harrison G., et al., Evidence-Based Recommendations for the Assessment and Management of Sleep Disorders in Older Persons, J Am Geriatr Soc 57:761-789, 2009 (30 pages).

Bolden, Norman, et al., Avoiding Adverse Outcomes in Patients with Obstructive Sleep Apnea (OSA): Development and Implementation of a Perioperative OSA Protocol, Journal of Clinical Anesthesia (2009) 21, 286-293 (8 pages).

Bourne, Richard S., et al., Clinical Review: Sleep Measurement in Critical Care Patients: Research and Clinical Implications, Critical Care 2007, 11:226 (17 pages).

Brown, Carlos VR and George C. Velmahos, The Consequences of Obesity on Trauma, Emergency Surgery, and Surgical Critical Care, World Journal of Emergency Surgery 2006, 1:27 (5 pages).

Bush, Haydn, Screening for Sleep Apnea, American Hospital Association Health Forum, Hospital & Healt Networks, hhn@omeda.com, 2013 (2 pages).

Camilo, Millene R., et al., Supine Sleep and Positional Sleep Apnea After Acute Ischemic Stroke and Intracerebral Hemorrhage, Clinics 2012; 67(12); 1357-1360 (4 pages).

Carr, Gordon E., et al., Acute Cardiopulmonary Failure From Sleep-Disordered Breathing, Chest 2012; 141(3); 798-808 (11 pages).

Casey, Kenneth R. and Michael J. Lefor, Management of the Hospitalized Patient with Sleep Disordered Breathina. Current Opinion in Pulmonary Medicine 2002, 8:511-515 (5 pages).

(56) References Cited

OTHER PUBLICATIONS

Chia, P., et al., The Association of Pre-Operative STOP-BANG Scores with Postoperative Critical Care Admission, Anaesthesic3 2013, 68, 950-952 (3 pages).
Choi, Jae-Kap, et al., Effect of Jaw and Head Position on Airway Resistance in Obstructive Sleep Apnea, Sleep and Breathing, vol. 4, No. 4, 163-168, 2000 (8 pages).
Choi, Ji Ho, et al., Efficacy Study of a Vest-Type Device for Positional Therapy in Position Dependent Snorers, Sleep and Biological Rhythms 2009; 7; 181-187 (7 pages).
Chung, Sharon A., et al., A Systemic Review of Obstructive Sleep Apnea and Its Implications for Anesthesiologists, Ambulatory Anesthesiology, vol. 107, No. 5, Nov. 2008, 1543-1563 (21 pages).
Chung, F., et al., High STOP-Band Score Indicates a High Probability of Obstructive Sleep Apnoea, British Journal of Anaesthesia 108 (5): 768-75 (2012), (8 pages).
Chung, Frances and Babak Mokhlesi, Postoperative Complications Associates with Obstructive Sleep Apnea: Time to Wake Up!, Anesthesia & Analgesia, Feb. 2014, vol. 118, No. 2, 251-253 (3 pages).
Chung, Frances et al., Preoperative Identification of Sleep Apnea Risk in Elective Surgical Patient6s, Using the Berlin Ouestionnaire, Journal of Clinical Anesthesia (2007) 19, 130-134 (5 pages).
Chung, Frances and Hisham Elsaid, Screening for Obstructive Sleep Apnea Before Surgery: Why is it Important?, Current Opinion in Anaesthesiology 2009, 22:405-411 (7 pages).
Chung, Frances, et al., Validation of the Berlin Questionnaire and American Society of Anesthesiologists Checklist as Screening Tools for Obstructive Sleep Apnea in Surgical Patients, Anesthesiology, vol. 108, No. 5, May 2008, 822-830 (9 pages).
Curry, J. Paul and Lawrence A. Lynn, Threshold Monitoring, Alarm Fatigue, and the Patterns of Unexpected Hospital Death, The Official Journal of the Anesthesia Patient Safety Foundation, Fall 2011 (8 pages).
D'Apuzzo, Michele R. and James A. Browne, Obstructive Sleep Apnea as a Risk Factor for Postoperative Complications After Revision Joint Arthroplasty, The Journal of Arthroplasty, vol. 27, No. 8, Suppl. 1 (2012), 95-98 (4 pages).
Den Herder, Cindy et al., Risks of General Anaesthesia in People with Obstructive Sleep Apnoea, British Medical Journal, vol. 329, Oct. 23, 2004, 955-959 (5 pages).
Dolezal, Donna, et al., Implementing Preoperative Screening of Undiagnosed Obstructive Sleep Apnea, Journal of PeriAnesthesia Nursing, vol. 26, No. 5 Oct. 2011, 338-342 (5 pages).
Ead, Heather, Meeting the Challenge of Obstructive Sleep Apnea: Developing a Protocol that Guides Perianesthesia Patient Care, Journal of PeriAnesthesia Nursing, vol. 24, No. 2 Apr. 2009, 103-113 (11 pages).
Farney, Robert J., et al., The STOP-Bang Equivalent Model and Prediction of Severity of Obstructive Sleep Apnea: Relation to Polysomnographic Measurements of the Apnea/Hypopnea Index, Journal of Clinical Sleep Medicine, vol. 7, NcU5, 2011, 459-467 (9 pages).
Finkel, Kevin J., et al., Prevalence of Undiagnosed Obstructive Sleep Apnea Among Adult Surgical Patients in an Academic Medical Center, Sleep Medicine 10 (2009) 753-758 (6 pages).
Finucane, Thomas E., Evidence-Based Recommendations for the Assessment and Management of Sleep Disorders in Older Persons, JAGS, Nov. 2009, vol. 57, No. 11,2173-2174 (3 pages).
Fletcher, Eugene C., "Near Miss" Death in Obstructive Sleep Apnea: A Critical Care Syndrome, Critical Care Medicine, vol. 19, No. 9, Sep. 1991, 1158-1164 (7 pages).
Galhotra, Sanjay, Mature Rapid Response System and Potentially Avoidable Cardiopulmonary Arrests in Hospital, Qual. Saf. Health Care 2007, 16:260-265 (6 pages).
Gammon, Brian T. and Karen F. Ricker, An Evidence-Based Checklist for the Postoperative Management of Obstructive Sleep Apnea, Journal of PeriAnesthesia Nursing, vol. 27, No. 5 Oct. 2012, 316-322 (7 pages).
Gay, Peter C., Sleep and Sleep-Disordered Breathing in the Hospitalized Patient, Respiratory Care, Sep. 2010, vol. 55, No. 9, 1240-1254 (15 pages).
Gay, Peter C., The Value of Assessing Risk of Obstructive Sleep Apnea in Surgical Patients: It Only Takes One, Journal of Clinical Sleep Medicine, vol. 6, No. 5, 2010, 473-474 (2 pages).
Global Industry Analysts, Inc., GIA Market Report: Sleep Apnea Diagnostic and Therapeutic Devices, A Global Strategic Business Report, MCP-3307, Oct. 2010, www.StrategyR.com, (321 pages).
Ramachandran, Satya Krishna, et al., Derivation and Validation of a Simple Perioperative Sleep Apnea Prediction Score, Society for Ambulatory Anesthesiology, vol. 110, No. 4 (Apr. 2010), 1007-1015 (9 pages).
Ravesloot, M.J.L. and N. de Vries, Calculation of Surgical and Non-Surgical Efficacy for OSA / Reliable Calculation of the Efficacy of Non-Surgical and Surgical Treatment of Obstructive Sleep Apnea Revisted, vol. 34, Issue 01 (2001) 105-110 (2 pages).
Ravesloot, M.J.L., et al., The Undervalued Potential of Positional Therapy in Position-Dependent Snoring and Obstructive Sleep Apnea—A Review of the Literature, Sleep Breath, published online Mar. 24, 2012 (11 pages).
Ravesloot, Madeline J.L., et al., Treatment Adherence Should be Taken into Account when Reporting Treatment Outcomes in Obstructive Sleep Apnea, Sleep Medicine, vol. 124, Issue 1 (Jan. 2014) 344-345 (3 pages).
Richardson, Annette and Anne Killen, How Long do Patients Spend Weaning from CPAP in Critical Care?, Intensive and Critical Care Nursing (2006) 22, 206-213 (8 pages).
Rosenberg, Russell and Paul Doghramji, Optimal Treatment of Obstructive Sleep Apnea and Excessive Sleepiness, Springer Healthcare Communication, published online Apr. 3, 2009, 295-312 (18 pages).
Rosenthal, Leon, Got CPAP? Use it in the Hospitall, Sleep Breath, published online Nov. 25, 2011 (4 pages).
Safiruddin, Faiza, et al., Analysis of the Influence of Head Rotation During Drug-Induced Sleep Endoscopy in Obstructive Sleep Apnea, Laryngoscope 124: Sep. 2014, 2195-2199 (5 pages).
Seet, Edwin and Frances Chung, Obstructive Sleep Apnea: Preoperative Assessment, Anesthesiology Clin 28 (2010) 199-215 (17 pages).
Seet, Edwin, et al., Perioperative Clinical Pathways to Manage Sleep-Disordered Breathing, Sleep Med Clin 8 (2013) 105-120 (16 pages).
Sforza, Emilia, et al., A 3-Year Longitudinal Study of Sleep Disordered Breathing in the Elderly, European Respiratory Journal, vol. 40, No. 3 (2012) 665-672 (8 pages).
Sforza, E., et al., Natural Evolution of Sleep Apnoea Syndrome: A Five Year Longitudinal Study, European Respiratory Journal, 1994, 7, 1765-1770 (6 pages).
Shafazand, Shirin, Perioperative Management of Obstructive Sleep Apnea: Ready for Prime Time?, Cleveland Clinic Journal of Medicine, vol. 76, Supp. 4, Nov. 2009 (6 pages).
Siddiqui, Fouzia, et al. Half of Patients with Obstructive Sleep Apnea have a Higher NREM AHi than REM AH/, Sleep Medicine 7 (2006) 281-285 (5 pages).
Singh, M., et al., Proportion of Surgical Patients with Undiagnosed Obstructive Sleep Apnoea, British Journal of Anaesthesia 110 (4); 629-636 (2013) (8 pages).
Skinner, Margot A., et al., Elevated Posture for the Management of Obstructive Sleep Apnea, Sleep and Breathing, vol. 8, No. 4 (2004) 193-200 (10 pages).
Author Unknown, There's More than One Way to Improve Nightime Breathing, European Sleep Works, http://www.sleepworks.com/resource/medical-needs/sleep-apnea (2014) (3 pages).
Park, Steven V., Sleep Apnea CPAP Compliance Craziness, Doctor Steven Y_ Park, MD New York, NY Integrative Solutions for Obstructive Sleep Apnea, Upper Airway Resistance Syndrome, and Snoring (Nov. 10, 2009) (7 pages).
Monk, Timothy H., et al., Measuring Sleep Habits Without Using a Diary: The Sleep Timing Questionnaire, Sleep, vol. 26, No. 2 (2003) 208-212 (5 pages).

(56) References Cited

OTHER PUBLICATIONS

Sorscher, Adam J. and Evan M. Caruso, Frequency of Provision of CPAP in the Inpatient Setting: An Observational Study, Sleep Breath, published online Nov. 23, 2011 (6 pages).
Spurr, Kathy F., et al., Prevalence of Unspecified Sleep Apnea and the use of Continuous Positive Airway Pressure in Hospitalized Patients, 2004 National Hospital Discharge Survey, Sleep Breath (2008) 12:229-234 (8 pages).
Srijithesh PR, et al., Positional Therapy for Obstructive Sleep Apnoea (Protocol), The Cochrane Library 2014, Issue 2 (11 pages).
Sundar, Eswar, et al., Perioperative Screening for the Management of Patients with Obstructive Sleep Apnea, JCOM, vol. 18, No. 9, Sep. 2011, 399-411 (13 pages).
Szollosi, Irene, et al., Lateral Sleeping Position Reduces Severity of Central Sleep Apnea/Cheyne-Stokes Respiration, Sleep, vol. 29, No. 8 (2006), 1045-1051 (7 pages).
Author Unknown, A Promising Concept of Combination Therapy for Positional Obstructive Sleep Apnea, Sorim:ier Link, http://link.springer.com/article/10.1007/s11325-014-1068-8, Oct. 2014 (4 pages).
Author Unknown, Upper Airway Collapse During Drug Induced Sleep Endoscopy: Head Rotation in Supine Position Compared with Lateral Head and Truck Position, Springer Link, http://link.springer.com/article/10.1007/s00405-014-3215-z, Aug. 2014 (4 pages).
Vasu, Tajender S., et al., Obstructive Sleep Apnea Syndrome and Postoperative Complications, Arch Otolarvnaol Head Neck Sura. vol. 136, No. 10, Oct. 2010 (5 pages).
Matthews, Dan, Mattresses—A Futile Weapon in the Fight Against Sleep Apnea, http://www.danmatthewsdds.com/mattresses-%E2%80%93-futile-weapon-fight-sleep-apnea/ (2014) (1 page).
Marks, Steve, Hospital Care of Patients with Sleep Apnea, Arete Sleep Health, last modified on May 16, 2013 (63 pages).
Carlisle, Heather, The Case for Capnography in Patients Receiving Opioids, American Nurse Today, vol. 9, No. 9 (Sep. 2014) 22-27 (69 pages).
Gold, Jenny, The Sleep Apnea Business Is Booming, And Insurers Aren't Happy, NPR_ApnesvsInsurers.mht, (Jan. 16, 2012) (3 pages).
Author unknown, Sleep right, Sleep tight, Natural sleep before medicines, Sleep Diary, www.nps.org.au/sleep, last modified Jul. 7, 2010 (4 pages).
Quan, S. F., Evolution of OSA, Thorax 1998; 53:532 (4 pages).
Maurer, J. T., et al., Treatment of Obstructive Sleep Apnea with a New Vest Preventing the Supine Position, Thieme—Connect (2003) (1 page).
Schreuder, K.E., The Effect of Cervical Positioning on Benign Snoring by Means of a Custom-Fitted Pillow, Centre for Sleep and Wake Disorders Kempenhaeghe, 5591 VE HEEZE, the Netherlands, last modified Dec. 1, 2011 (4 pages).
Chung, Frances, Semi-up Right Position Study, Clinical Trials.gov, last updated May 28, 2014 (5 pages).
Author Unknown, National Sleep Foundation Sleep Diary, National Sleep Foundation, last modified Apr. 18, 2003 (2 pages).
Takaoka, Shanon, CPAP Adherence, Is it too much "pressure"?, Feb. 7, 2007 (41 pages).
Seren, Suaf, The Effect of Pure Prone Positioning Therapy for the Patients With Mild to Moderate Obstructive Sleep Apnea, ClinicalTrials.gov, last updated Jun. 7, 2011 (4 pages).
Jackman, Shawn M. and Bruce Hubbert, Riding the Wireless Wave (without wiping out), HIMSS12 Annual Conference & Exhibition, last modified Feb. 20, 2012 (133 pages).
De Vries, Nico and Madeline Ravesloot, Apnea Calculator, http://apneacalculator.com (2014) (2 pages).
Oexman, Robert, Can a Mattress Really Impact Your Sleep?, Huffpost Healthy Living, Posted Oct. 14, 2012, 10:00 a.m. (8 pages).
Palmer, Laura and Suzanne R. Morrison, Obesity and Obstructive Sleep Apnea | Is there a limit for ambulatory surgery?, OR Nurse Journal, Sep. 2014 (9 pages).
Oksenberg, Arie, Are We Missing a Simple Treatment for Most Adults Sleep Apnea Patients? The Avoidance of the Supine Sleep Position, ResearchGate.net, Aug. 12, 2014 (2 pages).
Author Unknown, Obstructive Sleep Apnea (OSA), Care of Adult Patients, St. Anthony Central Hospital Clinical Standards, Jul. 8, 2009 (9 pages).
PCT Search Report and Written Opinion for PCT/US2014/18033, completed Aug. 18, 2014 (17 pages).
O'Connor, Anahad, Treating Sleep Apnea Without the Mask, NYTimes.com, Apr. 9, 2012 (7 pages).
Stradling, J. R. and R. J. 0. Davies, Sleep 1: Obstructive Sleep Apnea/Hypopnoea Syndrome: Definitions, Epidemiology, and Natural History, Thorax 2004;59:73-78 (6 pages).
Pyke, Josh, et al, Continuous Pulse Oximetry Monitoring in the Inpatient Population, Patient Safety & Quality Healthcare, May/Jun. 2009 (5 pages).
EP Search Report for Application No. EP 13 79 3571, dated Sep. 8, 2015 (9 pages).
Joosten, S.A., et al., Obstructive Sleep Apnea Phenotypic Trait Changes from Supine to Lateral Position, Am J Respir Grit Care Med 189; 2014; A3909 (1 page).
Joshi, Girish P., et al., Society for Ambulatory Anesthesia Consensus Statement on Preoperative Selection of Adult Patients with Obstructive Sleep Apnea Scheduled for Ambulatory Surgery, Anesthesia & Ar,algesia, Nov. 2012, vol. 115, No. 5, 1060-1068 (9 pages).
Keenan, Sean P., et al., Clinical Practice Guidelines for the Use of Noninvasive Positive-Pressure Ventilation and Noninvasive Continuous Positive Airway Pressure in the Acute Care Setting, Canadian Medical Association Journal, Feb. 22, 2011, 183(3) (21 pages).
Khayat, Rami, et al., In-Hospital Resting for Sleep-Disordered Breathing in Hospitalized Patients with Decompensated Heart Failure: Report of Prevalence and Patient Characteristics, Journal of Cardiac Failure, vol. 15, No. 9 (2009) (739-746).
Kim, Eun Joong, The Prevalence and Characteristics of Positional Sleep Apnea in Korea, Korean J Otorhinolarvnqol—Head Neck Surq. 2009:52:407-12 (6 pages).
Kulkarni, Gaurav V., et al., Obstructive Sleep Apnea in General Surgery Patients: Is it More Common than we Think?, The American Journal of Surgery (2014) 207, 436-440 (5 pages).
Lakdawala, Linda, Creating a Safer Perioperative Environment With an Obstructive Sleep Apnea Screeninq Tool, Journal of PeriAnesthesia Nursing, vol. 26, No. 1 Feb. 2001, 15-24 (10 pages).
Lee, Chui Hee, et al., Changes in Site of Obstruction in Obstructive Sleep Apnea Patients According to Sleep Position: A OISE Study, Laryngoscope 00: Month 2014 (7 pages).
Lee, Jung Bok, et al., Determining Optimal Sleep Position in Patients with Positional Sleep-Disordered Breathing Using Response Surface Analysis, J. Sleep Res. (2009) 18, 26-35 (10 pages).
Lockhart, Ellen M., et al. Obstructive Sleep Apnea Screening and Postoperative Mortality in a Large Surgical Cohort, Sleep Medicine 14 (2013) 407-415 (9 pages).
Lynn, Lawrence A. and J. Paul Curry, Patterns of Unexpected In-Hospital Deaths: A Root Cause Analysis, Patient Safety in Surgery 2011, 5:3 (25 pages).
Mador, M. Jeffrey, et al., Are the Adverse Effects of Body Position in Patients with Obstructive Sleep Apnea Dependent on Sleep Stage?, Sleep Breath (2010) 14:13-17 (7 pages).
Mador, M. Jeffrey, et al., Prevalence of Positional Sleep Apnea in Patients Undergoing Polysomnography, Chest 2005; 128:2130-2137 (8 pages).
Marcus, Howard, Obesity and Postoperative Surgical Risk, The Doctors Company, Third Quarter 2010, 1-8 (8 pages).
Martin-Du Pan, Remy, et al., The Role of Body Position and Gravity in the Symptoms and Treatment of Various Medical Diseases, Swiss Med. Wkly. 2004: 134:543-551 (10 pages).
Memtsoudis, Stavros G., et al., A Rude Awakening—The Perioperative Sleep Apnea Epidemic, N Engl. J. Med. 368:25, 2352-2353 (Jun. 20, 2013) (2 pages).
Menon, Akshay and Manoj Kumar, Influence of Body Position on Severity of Obstructive Sleep Apnea: A Systematic Review, Otolaryngology, vol. 2013, Article ID 670381 (2013) (8 pages).
Mininni, Nicolette C., et al., Pulse Oximetry: An Essential Tool for the Busy Med-Surg Nurse, American Nurse Today, Nov./Dec. 2009, 31-33 (3 pages).

(56) References Cited

OTHER PUBLICATIONS

Mokhlesi, Babak, Empiric Postoperative Autotitrating Positive Airway Pressure Therapy | Generating Evidence in the Perioperative Care of Patients at Risk for Obstructive Sleep Apnea, Chest 144/1 (Jul. 2013) 57 (3 pages).
Mull, Yvonne and Marshall Bedder, Obstructive Sleep Apnea Syndrome in Ambulatory Surgical Patients, AORN Journal, vol. 76, No. 3 , 458-462 (Sep. 2002) (5 pages).
Nader, Nizar Z., et al., Newly Identified Obstructive Sleep Apnea in Hospitalized Patients: Analysis of an Evaluation and Treatment Strategy, Journal of Sleep Medicine, vol. 2, No. 4, 2006, 431-437 (7 Pages).
Pevernagie, Dirk A., et al., Effects of Body Position on the Upper Airway of Patients with Obstructive Sleep Apnea, Am J Respir Grit Care Med, vol. 152, 179-185, 1995 (7 pages).
Qureshi, Asher and Robert D. Ballard, Obstructive Sleep Apnea, J Allergy Clin Immunol, vol. 112, No. 4, 643-651 (2003) (9 pages).
Richard, Wietske, et al., The Role of Sleep Position in Obstructive Sleep Apnea Syndrome, Eur Arch Otorhinolaryngol (2006) 263:946-950 (5 pages).
Rocke, Daniel, et al., Effectiveness of a Postoperative Disposition Protocol for Sleep Apnea Surgery, American Journal of Otolaryngology—Head and Neck Medicine and Surgery 34 (2013) 273-277 (5 pages).
Gabbott, D.A., The Effect of Single-Handed Cricoid Pressure on Neck Movement After Applying Manual In-Line Stabilisation, Anaesthesia, 1997, 52, 586-602 (17 pages).
Ross, Jacqueline, Obstructive Sleep Apnea: Knowledge to Improve Patient Outcomes, Journal of PeriAnesthesia Nursing, vol. 23, No. 4 Aug. 2008, 273-275 (3 pages).
Setaro, Jill, Obstructive Sleep Apnea: A Standard of Care That Works, Journal of PeriAnesthesia Nursing, vol. 27, No. 5 Oct. 2012, 323-328 (6 pages).
Sheldon, Alison, et al., Nursing Assessment of Obstructive Sleep Apnea in Hospitalised Adults: A Review of Risk Factors and Screening Tools, Contemporary Nurse, vol. 34, Issue 1, Dec. 2009/Jan. 2010, 19-33 (16 pages).
Skinner, Margot A., et al., Efficacy of the 'Tennis Ball Technique' Versus nCPAP in the Management of Position-Dependent Obstructive Sleep Apnoea Syndrome, Respirology (2008) 13, 708-715 (8 pages).
Stearns, Joshua D. and Tracey L. Stierer, Peri-Operative Identification of Patients at Risk for Obstructive Sleeo Aonea, Seminars in Anesthesia, Perioperative Medicine and Pain (2007) 26, 73-82 (10 pages).
Van Kesteren, Ellen R., et al., Quantitative Effects of Trunk and Head Position on the Apnea Hypopnea Index in Obstructive Sleep Apnea, Sleep, vol. 34, No. 8 (2011), 1075-1081 (7 pages).
Veasey, Sigrid C., et al., Medical Therapy for Obstructive Sleep Apnea: A Review by the Medical Therapy for Obstructive Sleep Apnea Task Force of the Standards of Practice Committee of the American Academy of Sleep Medicine, Sleep, vol. 29, No. 8 (2006), 1036-1044 (9 pages).
Wolfson, Alexander, et al., Postoperative Analgesia for Patients with Obstructive Sleep Apnea Syndrome, Seminars in Anesthesia, Perioperative Medicine and Pain (2007), 26, 103-109 (7 pages).
Yantis, Mary Ann, Decreasing Surgical Risks for Patients with Obstructive Sleep Apnea, AORN Journal, vol. 68, No. 1 (Jul. 1998), 50-55 (6 pages).
Ravesloot, M.J.L., and N. de Vries, Reliable Calculation of the Efficacy of Non-Surgical Treatment of Obstructive SleefJ Aonea Revisted, Sleep, vol. 34, No. 1 (2011), 105-110 (6 pages).
Moon, II Joan, et al., Sleep Magnetic Resonance Imagine as a New Diagnostic Method in Obstructive Sleep Apnea Syndrome, Laryngoscope 120: Dec. 2010, 2546-2554 (9 pages).
Nepomnayshy, Dmitry, et al., Sleep Apnea: Is Routine Preoperative Screening Necessary?, OBES Surg (2013) 23:287-192 (5 pages).
Press Release: World's Leading Health Media Promotes Disinformation on Best Sleeping Positions (Sep. 22, 2010), Sleeping Positions Research Summary (24 Studies), http://www.normalbreathing.com/l-6-best-sleep-positions.php (14 pages).
Oksenberg, Arie, et al., Association of Body Position with Severity of Apneic Events in Patients with Severe Nonpositional Obstructive Sleep Apnea, Chest 2000; 118; 1018-1024 (9 pages).
Oksenberg, Arie, The Avoidance of the Supine Posture during Sleep for Patients with Supine-related Sleep Apnea, BSM Protocols for Adherence and Treatment of Intrinsic Sleep Disorders, Chapter 23, 223-236 (14 pages).
Oksenberg, Arie and Donald Silverberg, The Effect of Body Posture on Sleep-Related Breathing Disorders: Facts and Therapeutic Implications, Sleep Medicine Reviews, vol. 2, No. 3, 139-162 (1998) (25 pages).
Oksenberg, Arie, et al., Positional Therapy for Obstructive Sleep Apnea Patients: A 6-Month Follow-Up Study, Laryngoscope 116, Nov. 2006, 1995-2000 (6 pages).
Oksenberg, Arie, et al., REM-Related Obstructive Sleep Apnea: The Effect of Body Position, Journal of Clinical Sleep Medicine, vol. 6, No. 4 (2010), 343-348 (6 pages).
Ozeke, Ozcan, et al., Influence of the Right- Versus Left-Sided Sleeping Position on the Apnea-Hypopnea Index in Patients with Sleep Apnea, Sleep Breath, published online Jun. 16, 2011 (5 pages).
Ozeke, Ozcan, et al., Sleep Apnea, Heart Failure, and Sleep Position, Sleep Breath, published online Nov. 9, 2011 (4 pages).
Permut, Irene, et al., Comparison of Positional Therapy to CPAP in Patients with Positional Obstructive Sleep Apnea, Journal of Clinical Sleep Medicine, vol. 6, No. 3 (2010), 238-243 (6 pages).
Author Unknown, Positioning of Surgical Patients With Sleep Apnea, ClinicalTrials.gov, htto://clinicaltrials.qov/ct2/show/NCT02123238?term=apnea+and+position&rank=3(2014) (5 pages).
Author Unknown, Obstructive Sleep Apnea May Block the Path to a Positive Postoperative Outcome, 2007 Pennsylvania Patient Safety Authority, reprinted from the PA-PSRS Patient Safety Advisory, vol. 4, No. 3 (Sep. 2007) (8 pages).
Proczko, Monika, et al., STOP-Bang and the Effect on Patient Outcome and Length of Hospital Stay when Patients are not Using Continuous Positive Airway Pressure, J Anesth, published online May 29, 2014 (7 pages).
Service Manual—"TotalCare® Bed System" from Hill-Rom, Product No. P1900, MAN112 Rev 7, by Hill-Rom Services, Inc. (2007) (1105 pages).
User Manual—"TotalCare® Bed System" from Hill-Rom, Product No. P1900, USR042 REV11, by Hill-Rom Services, Inc. (2009) (112 pages).
PCT Search Report for PC5T/US2013/042313, completed Dec. 6, 2013 (4 pages).
SleepEducation—Blog, "Positional therapy harness helps reduce sleep apnea for some," www.sleepeducation.com, posted Friday, Jun. 18, 2010 (7 pages).
SPANAmerica: PressureGuard® Turn Select®, www.archive.org/web/20090201172625/http://spanamerica.com/turn_select.php; Aug. 18, 2014 (2 pages).
Extended European Search Report, European Application No. 19200203.8, completed Nov. 20, 2019, (7 pages).
Gibson, G. J., Obstructive Sleep Apnoea Syndrome: Underestimated and Undertreated, British Medical Bulletin 2004; 72: 49-64 (16 pages).
Gupta, Rakesh M., et al., Postoperative Complications in Patients With Obstructive Sleep Apnea Syndrome Undergoing Hip or Knee Replacement: A Case-Control Study, May Clin Proc. 2001; 76:897-905 (9 pages).
Guralnick, Amy S., et al., CPAP Adherence in Patients with Newly Diagnosed Obstructive Sleep Apnea Prior to Elective Surgery, Journal of Clinical Sleep Medicine, vol. 8, No. 5, 2012, 501-506 (6 pages).
Heinzer, Raphael C., et al., Positional Therapy for Obstructive Sleep Apnea: An Objective Measurement of Patients' Usage and Efficacy at Home, Sleep MedicineJ3 (2012) 425-428 (4 pages).
Hoque, Enamul, et al., Monitoring Body Positions and Movements During Sleep Using WISPs, Wireless Health '10, Oct. 5-7, 2010 (10 pages).

(56) References Cited

OTHER PUBLICATIONS

Isono, Shiroh, et al., Lateral Position Decreases Collapsibility of the Passive Pharynx in Patients with Obstructive Sleep Apnea, Anesthesiology, VoUn. No. 4, Oct. 2002, 780-785 (6 pages).
Itasaka, Yoshiaki and Kazuo Ishikawa, The Influence of Sleep Position and Obesity on Sleep Apnea, Psychiatry and Clinical Neurosciences (2000), 54, 340-341 (3 pages).
Jensen, Candice, et al., Postoperative CPAP and BiPAP Use Can be Safely Omitted after Laparoscopic Roux-en-Y Gastric Bypass, Surgery for Obesity and Related Diseases 4 (2008) 512-514 (3 pages).
Joho, Shuji, et al., Impact of Sleeping Position on Central Sleep Apnea/Cheyne-Stokes Respiration in Patients with Heart Failure, Sleep Medicine 11 (2010) 143-148 (6 pages).
Jokic, Ruzica, et al., Positional Treatment vs. Continuous Positive Airway Pressure in Patients with Positional Obstructive Sleep Apnea Syndrome, Chest/115/3/Mar. 1999, 771-781 (11 pages).

* cited by examiner

OBLIQUE HINGED PANELS AND BLADDER APPARATUS FOR SLEEP DISORDERS

CROSS-REFERENCE TO RELATED APPLICATIONS

The present application is a continuation of U.S. application Ser. No. 16/787,331, filed Feb. 11, 2020, now U.S. Pat. No. 10,959,534, which claims the benefit, under 35 U.S.C. § 119(e), of U.S. Provisional Application 62/811,605, filed Feb. 28, 2019, each of which is expressly incorporated by reference herein.

BACKGROUND

The present disclosure relates to a head elevation apparatus, and more particularly, to a head elevation apparatus having panels to laterally rotate a person's head and torso to treat sleep disorders.

The subject matter disclosed herein relates generally to adverse event mitigation devices, systems, and methods and, more particularly, but not exclusively, to devices, systems, and methods for the prevention and treatment of sleep apnea. The embodiments described herein may also be effective in reducing snoring. While various adverse event mitigation devices, systems, and methods have been developed, there is still room for improvement. Thus, a need persists for further contributions in this area of technology.

SUMMARY

The present disclosure includes one or more of the features recited in the appended claims and/or the following features which, alone or in any combination, may comprise patentable subject matter.

According to an aspect of the disclosed embodiments, a head elevation apparatus configured to be positioned under a mattress may include a base panel. A top panel may be positioned on the base panel. The top panel may include a center panel hingedly coupled to the base panel. An upper flap may be hingedly coupled to the center panel. A lower flap may be hingedly coupled to the center panel. The center panel may be configured to move between a collapsed position and a raised position relative to the base panel. When the center panel is moved to the raised position, the upper flap and the lower flap may rotate relative to the center panel.

In some embodiments, the center panel may be hingedly coupled to the base panel along a center hinge that may extend at a first oblique angle relative to a front face of the base panel. The upper panel may be hingedly coupled to the center panel along an upper hinge that may extend at a second oblique angle relative to the front face. The upper hinge may extend at a third oblique angle relative to the center hinge. The lower panel may be hingedly coupled to the center panel along a lower hinge that may extend at a fourth oblique angle relative to the front face. The lower hinge may extend at a fifth oblique angle relative to the center hinge. The upper panel may be hingedly coupled to the center panel along an upper hinge. The lower panel may be hingedly coupled to the center panel along a lower hinge. The lower hinge may extend at a sixth oblique angle relative to the upper hinge.

Optionally, moving the center panel to the raised position may alter a lateral angle of the mattress. The center panel may be movable to a plurality of intermediate positions between the collapsed position and the raised position. The lateral angle of the mattress may be different at each intermediate position.

Alternatively or additionally, a bladder may be positioned between the base panel and the center panel. The bladder may be inflatable and deflatable to move the center panel between the collapsed position and the raised position. The bladder may include a lower bladder and an upper bladder coupled to the lower bladder. The upper bladder may be positioned adjacent the center panel. The lower bladder may be positioned adjacent the base panel.

It may be desired that the base panel may include a lower panel and an upper panel. The upper panel may be hingedly coupled to the lower panel and configured to move between a retracted positioned and an extended position. The upper panel may move to the extended position to alter a longitudinal angle of the mattress. The upper panel may be movable to a plurality of intermediate positions between the retracted positioned and the extended position. A bladder may be positioned between the upper panel and the lower panel. The bladder may be inflatable and deflatable to move the upper panel between the retracted position and the extended position. The bladder may include an upper bladder and a lower bladder coupled to the upper bladder. The upper bladder may be positioned adjacent the upper panel. The lower bladder may be positioned adjacent the lower panel.

According to another aspect of the disclosed embodiments, a head elevation apparatus configured to be positioned under a mattress may include a base panel. A top panel may be positioned on the base panel. The top panel may include a center panel hingedly coupled to the base panel along a center hinge that may extend at a first oblique angle relative to a front face of the base panel. An upper flap may be hingedly coupled to the center panel along an upper hinge that may extend at a second oblique angle relative to the front face. The upper hinge may extend at a third oblique angle relative to the center hinge. A lower flap may be hingedly coupled to the center panel along a lower hinge that may extend at a fourth oblique angle relative to the front face. The lower hinge may extend at a fifth oblique angle relative to the center hinge. The center panel may be configured to move between a collapsed position and a raised position relative to the base panel. When the center panel is moved to the raised position, the upper flap and the lower flap may rotate relative to the center panel. In some embodiments, the lower hinge may extend at a sixth oblique angle relative to the upper hinge.

Optionally, moving the center panel to the raised position may alter a lateral angle of the mattress. The center panel may be movable to a plurality of intermediate positions between the collapsed position and the raised position. The lateral angle of the mattress may be different at each intermediate position.

Additionally or alternatively, a bladder may be positioned between the base panel and the center panel. The bladder may be inflatable and deflatable to move the center panel between the collapsed position and the raised position. The bladder may include a lower bladder and an upper bladder coupled to the lower bladder. The upper bladder may be positioned adjacent the center panel. The lower bladder may be positioned adjacent the base panel.

It may be contemplated that the base panel may include a lower panel and an upper panel. The upper panel may be hingedly coupled to the lower panel and configured to move between a retracted position and an extended position. The upper panel may move to the extended position to alter a longitudinal angle of the mattress. The upper panel may be movable to a plurality of intermediate positions between the retracted position and the extended position. A bladder may be positioned between the upper panel and the lower panel. The bladder may be inflatable and deflatable to move the upper panel between the retracted position and the extended position. The bladder may include an upper bladder and a lower bladder coupled to the upper bladder. The upper bladder may be positioned adjacent the upper panel. The lower bladder may be positioned adjacent the lower panel.

According to yet another aspect of the disclosed embodiments, a head elevation apparatus configured to be positioned under a mattress may include a base panel. A top panel may be positioned on the base panel. The top panel may include a center panel hingedly coupled to the base panel along a center hinge. An upper flap may be hingedly coupled to the center panel along an upper hinge. A lower flap may be hingedly coupled to the center panel along a lower hinge. The center panel may be configured to move between a collapsed position and a raised position relative to the base panel. When the center panel is moved to the raised position, the upper flap and the lower flap may rotate relative to the center panel.

In some embodiments, the center hinge may extend at a first oblique angle relative to a front face of the base panel. The upper hinge may extend at a second oblique angle relative to the front face. The upper hinge may extend at a third oblique angle relative to the center hinge. The lower hinge may extend at a fourth oblique angle relative to the front face. The lower hinge may extend at a fifth oblique angle relative to the center hinge. The lower hinge may extend at a sixth oblique angle relative to the upper hinge.

Additionally or alternatively, moving the center panel to the raised position may alter a lateral angle of the mattress. The center panel may be movable to a plurality of intermediate positions between the collapsed position and the raised position. The lateral angle of the mattress may be different at each intermediate position.

Optionally, a bladder may be positioned between the base panel and the center panel. The bladder may be inflatable and deflatable to move the center panel between the collapsed position and the raised position. The bladder may include a lower bladder and an upper bladder coupled to the lower bladder. The upper bladder may be positioned adjacent the center panel. The lower bladder may be positioned adjacent the base panel.

It may be contemplated that the base panel may include a lower panel and an upper panel. The upper panel may be hingedly coupled to the lower panel and may be configured to move between a retracted positioned and an extended position. The upper panel may move to the extended position to alter a longitudinal angle of the mattress. The upper panel may be movable to a plurality of intermediate positions between the retracted positioned and the extended position. A bladder may be positioned between the upper panel and the lower panel. The bladder may be inflatable and deflatable to move the upper panel between the retracted position and the extended position. The bladder may include an upper bladder and a lower bladder coupled to the upper bladder. The upper bladder may be positioned adjacent the upper panel. The lower bladder may be positioned adjacent the lower panel.

According to a further aspect of the disclosed embodiments, a head elevation apparatus configured to be positioned under a mattress may include a base panel. A top panel may be positioned on the base panel. The top panel may include a center panel hingedly coupled to the base panel. An upper flap may be hingedly coupled to the center panel. A lower flap may be hingedly coupled to the center panel. A first bladder may be positioned between the center panel and the base panel. A blower may be coupled to the first bladder to inflate and deflate the first bladder. The center panel may be configured to move between a collapsed position and a raised position relative to the base panel when the first bladder is inflated and deflated. When the center panel is moved to the raised position, the upper flap and the lower flap may rotate relative to the center panel.

In some embodiments, the center panel may be hingedly coupled to the base panel along a center hinge that may extend at a first oblique angle relative to a front face of the base panel. The upper panel may be hingedly coupled to the center panel along an upper hinge that may extend at a second oblique angle relative to the front face. The upper hinge may extend at a third oblique angle relative to the center hinge. The lower panel may be hingedly coupled to the center panel along a lower hinge that may extend at a fourth oblique angle relative to the front face. The lower hinge may extend at a fifth oblique angle relative to the center hinge. The upper panel may be hingedly coupled to the center panel along an upper hinge. The lower panel may be hingedly coupled to the center panel along a lower hinge. The lower hinge may extend at a sixth oblique angle relative to the upper hinge.

Optionally, moving the center panel to the raised position may alter a lateral angle of the mattress. The center panel may be movable to a plurality of intermediate positions between the collapsed position and the raised position. The lateral angled of the mattress may be different at each intermediate position.

It may be desired that the base panel may include a lower panel and an upper panel. The upper panel may be hingedly coupled to the lower panel and may be configured to move between a retracted positioned and an extended position. The upper panel may move to the extended position to alter a longitudinal angle of the mattress. The upper panel may be movable to a plurality of intermediate positions between the retracted positioned and the extended position. A second bladder may be positioned between the upper panel and the lower panel. The second bladder may be inflatable and deflatable to move the upper panel between the retracted position and the extended position.

According to yet a further aspect of the disclosed embodiments, a head elevation apparatus configured to be positioned under a mattress may include a base panel that may have a lower panel and an upper panel. The upper panel may be hingedly coupled to the lower panel and may be configured to move between a retracted positioned and an extended position. A top panel may be positioned on the base panel. The top panel may include a center panel hingedly coupled to the base panel. The center panel may be configured to move between a collapsed position and a raised position relative to the base panel. An upper flap may be hingedly coupled to the center panel. A lower flap may be hingedly coupled to the center panel. A first bladder may be positioned between the center panel and the base panel. A second bladder may be positioned between the upper panel and the lower panel. When the center panel is moved to the raised position, the upper flap and the lower flap may rotate relative to the center panel to alter a lateral angle of the mattress. The upper panel may move to the extended position to alter a longitudinal angle of the mattress.

Optionally, the center panel may be hingedly coupled to the base panel along a center hinge that may extend at a first oblique angle relative to a front face of the base panel. The upper panel may be hingedly coupled to the center panel along an upper hinge that may extend at a second oblique angle relative to the front face. The upper hinge may extend at a third oblique angle relative to the center hinge. The lower panel may be hingedly coupled to the center panel along a lower hinge that may extend at a fourth oblique angle relative to the front face. The lower hinge may extend at a fifth oblique angle relative to the center hinge. The upper panel may be hingedly coupled to the center panel along an upper hinge. The lower panel may be hingedly coupled to the center panel along a lower hinge. The lower hinge may extend at a sixth oblique angle relative to the upper hinge.

Additionally or alternatively, the center panel may be movable to a plurality of intermediate positions between the collapsed position and the raised position. The lateral angle of the mattress may be different at each intermediate position. The upper panel may be movable to a plurality of intermediate positions between the retracted positioned and the extended position.

Additional features, which alone or in combination with any other feature(s), such as those listed above and/or those listed in the claims, can comprise patentable subject matter and will become apparent to those skilled in the art upon consideration of the following detailed description of various embodiments exemplifying the best mode of carrying out the embodiments as presently perceived.

BRIEF DESCRIPTION OF THE DRAWINGS

The detailed description particularly refers to the accompanying figures, in which.

DETAILED DESCRIPTION

Figure 1:
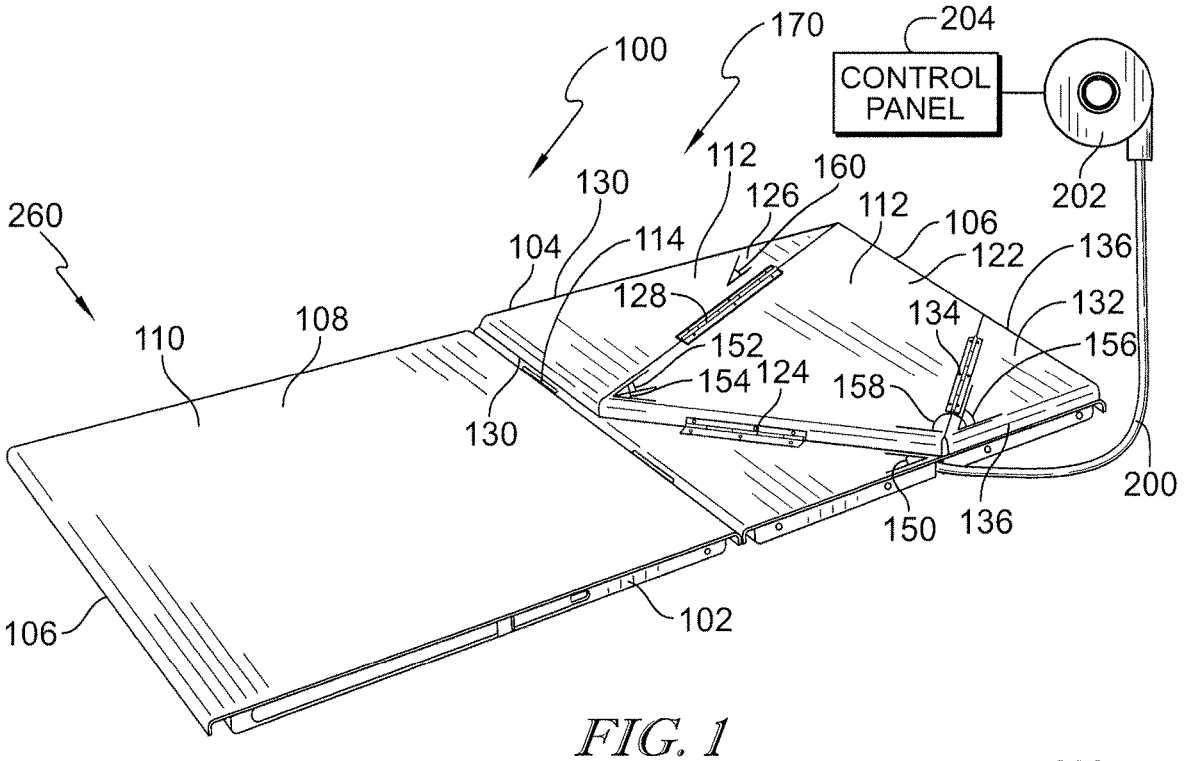
FIG. 1 is a top perspective view of a head elevation apparatus that includes a top panel hingedly coupled to a base panel, wherein the top panel is illustrated in a collapsed position.

Referring to FIG. 1, a head elevation apparatus 100 includes a front end 102 and a back end 104. A pair of side ends 106 extend between the front end 102 and the back end 104. The apparatus 100 includes a base panel 108 that is divided into a left side 110 and a right side 112 by a center line 114. The base panel 108 extends between the front end 102 and the back end 104. The base panel 108 also extends between the side ends 106. A top panel 120 is positioned over the right side 112 of the base panel 108. It should be appreciated that the top panel 120 may be positioned over the left side 110 of the base panel 108. In some embodiments, the apparatus 100 may include a top panel 120 positioned over each of the right side 112 and the left side 110 of the base panel 108. In some embodiments, the apparatus 100 may only include the right side 112 or the left side 110.

Figure 3:
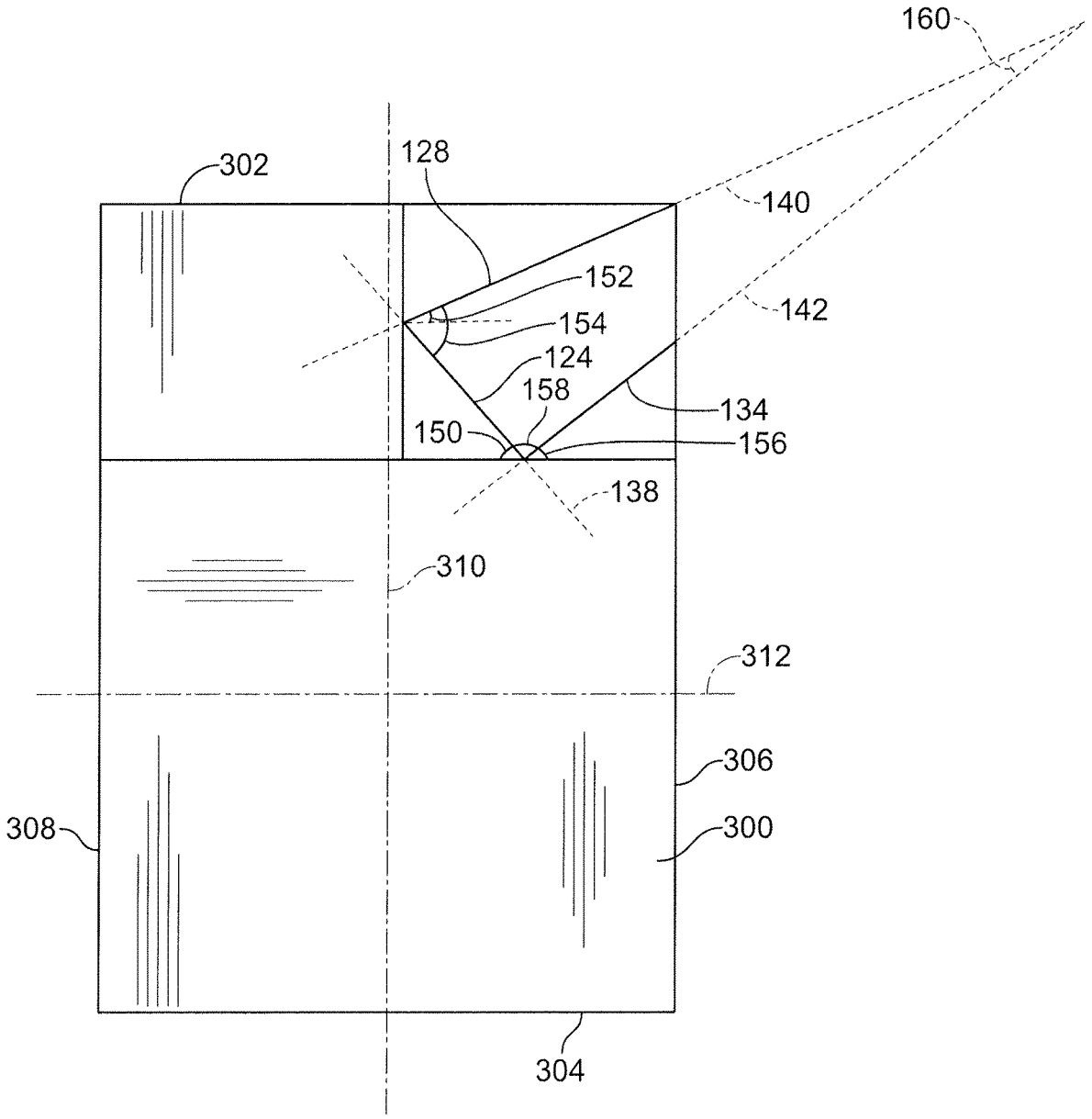
FIG. 3 is a top plan view of the head elevation apparatus is the collapsed position and positioned on a patient support apparatus.

The top panel 120 includes a center panel 122 that is hingedly coupled to the base panel 108 along a center hinge 124 for pivoting movement about a first axis 138 (shown in FIG. 3). An upper flap 126 is hingedly coupled to the center panel 122 along an upper hinge 128 for pivoting movement about a second axis 140 (shown in FIG. 3). The remaining sides 130 of the upper flap 126 are not coupled to anything so that the upper flap 126 can move freely relative to the base panel 108 as the center panel 122 is raised and lowered. The upper flap 126 is triangular is shaped; however, it will be appreciated that the upper flap 126 may be formed with other shapes. In some embodiments, the upper flap 126 is a scalene triangle. A lower flap 132 is hingedly coupled to the center panel 122 along a lower hinge 134 for pivoting movement about a third axis 142 (shown in FIG. 3). The remaining sides 136 of the lower flap 132 are not coupled to anything so that the lower flap 132 can move freely relative to the base panel 108 as the center panel 122 is raised and lowered. The lower flap 132 is triangular in shape; however, it will be appreciated that the lower flap 132 may be formed with other shapes. In some embodiments, the lower flap 132 is a scalene triangle.

In some embodiments, hinges 124, 128, and 134 include piano hinges having hinge plates interconnected by a hinge pin that defines the respective axes 138, 140, and 142 of the hinges 124, 128, and 134. In other embodiments, living hinges made of strips of flexible material, such as plastic material or cloth material, are used as hinges 124, 128, and 134.

The first axis 138 of the center hinge 124 extends at an oblique angle 150 relative to the front end 102. In some embodiments, the angle 150 is approximately 45 degrees. The first axis 138 of the center hinge 124 also extends at oblique angles (not shown) relative to the back end 104 and the side ends 106. The second axis 140 of the upper hinge 128 extends at an oblique angle 152 relative to the front end 102. In some embodiments, the angle 152 is approximately 23 degrees. The second axis 140 of the upper hinge also extends at oblique angles (not shown) relative to the back end 104 and the side ends 106. The second axis 140 of the upper hinge 128 extends at an oblique angle 154 relative to the first axis 138 of the center hinge 124. In some embodiments, the angle 154 is approximately 68 degrees. The third axis 142 of the lower hinge 134 extends at an oblique angle 156 relative to the front end 102. In some embodiments, the angle 156 is approximately 55.2 degrees. The third axis 142 of the lower hinge 134 also extends at oblique angles (not shown) relative to the back end 104 and the side ends 106. The third axis 142 of the lower hinge 134 extends at an oblique angle 158 relative to the first axis 138 of the center hinge 124. In some embodiments, the angle 158 is approximately 79.8 degrees. The third axis 142 of the lower hinge 134 also extends at an oblique angle 160 relative to the second axis 140 of the upper hinge 128. In some embodiments, the angle 160 is approximately 11.8 degrees. It will be appreciated, that the angles 150, 152, 154, 156, 158, and 160 may be altered to alter a configuration of the head elevation apparatus 100. In this disclosure, the term "oblique" means neither perpendicular nor parallel.

Figure 2:
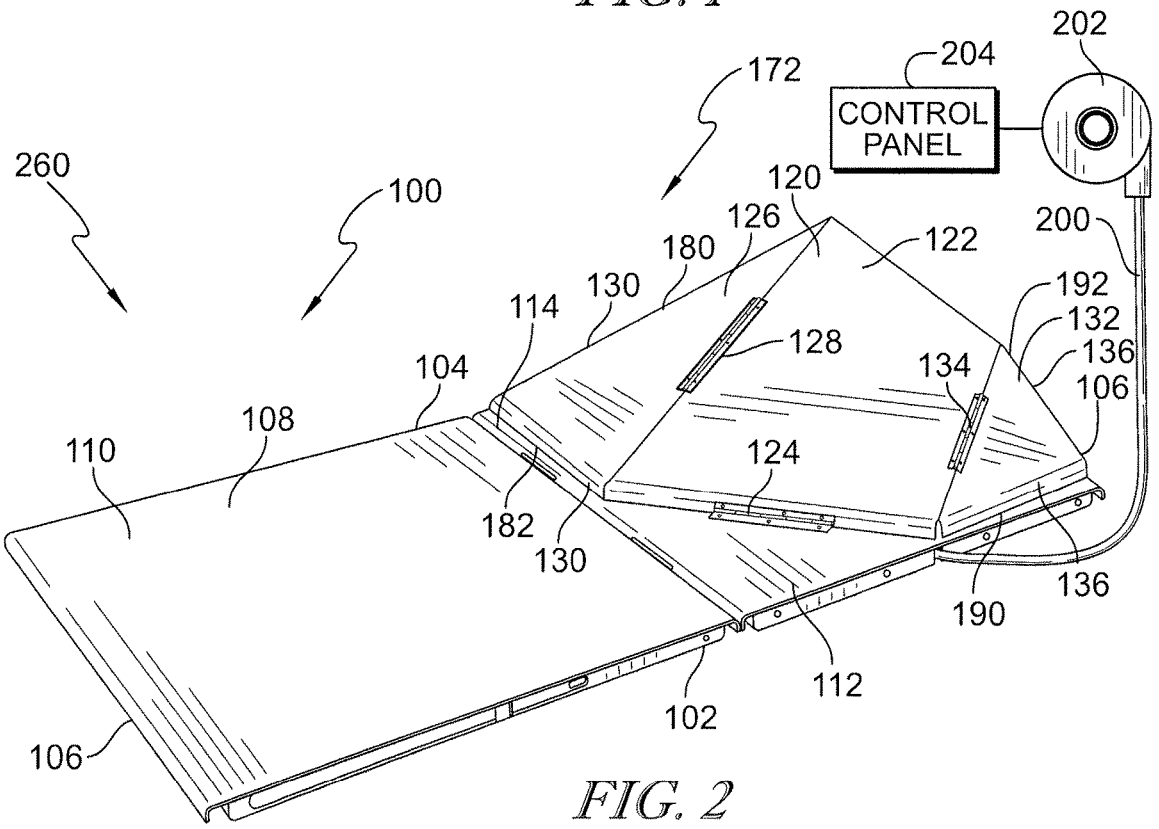
FIG. 2 is a top perspective view of the head elevation apparatus, wherein the top panel is illustrated in a raised position.

The center panel 122 is configured to move between a collapsed position 170 (shown in FIG. 1) and a raised position 172 (shown in FIG. 2). Referring now to FIG. 2, the center panel 122 rotates about the first axis 138 of the center hinge 124 to the raised position 172 relative to the base panel 108. When the center panel 122 is raised, the upper flap 126 rotates about the second axis 140 of the upper hinge 128 so that a free end 180 of the upper flap 126 moves inward away from the back end 104. Another free end 182 of the upper flap 126 moves inward away from the center line 114. The degree to which the free ends 180, 182 move is dependent on how high the center panel 122 is raised. In the collapsed position 170, the free end 180 is substantially co-planar with the back end 104 and the free end 182 is substantially co-planar with the center line 114. At the raised position 172, the free ends 180 and 182 are moved to maximum inward positions. If the center panel 122 is raised to an intermediate position between the collapsed position 170 and the raised position 172, the free end 180 is moved to an intermediate position between the back end 104 and the maximum position and the free end 182 is moved to an intermediate position between the center line 114 and the maximum position.

When the center panel 122 is raised, the lower flap 132 rotates about the third axis 142 of the lower hinge 134 so that a free end 190 of the lower flap 132 moves inward away from the front end 102. Another free end 192 of the lower flap 132 moves inward away from the side end 106. The degree to which the free ends 190, 192 move is dependent on how high the center panel 122 is raised. In the collapsed position 170, the free end 190 is substantially co-planar with the front end 102 and the free end 192 is substantially co-planar with the side end 106. At the raised position 172, the free ends 190 and 192 are moved to maximum inward positions. If the center panel 122 is raised to an intermediate position between the collapsed position 170 and the raised position 172, the free end 190 is moved to an intermediate position between the front end 102 and the maximum position and the free end 192 is moved to an intermediate position between the side end 106 and the maximum position.

Referring to both FIGS. 1 and 2, the center panel 122 is raised and lowered by a bladder (described in more detail below). That is, the bladder is inflated and deflated to move the center panel 122 between the collapsed position 170 and the raised position 172. As illustrated in FIGS. 1 and 2, a hose 200 extends from the bladder to a blower 202. The blower 202 is operable to inflate and deflate the bladder to raise and lower the center panel 122 between the collapsed position 170 and the raised position 172. A controller 204 may be coupled to the blower 202 to control the blower 202. The controller 204 may include inputs that allow a user to inflate or deflate the bladder to position the center panel 122 at the collapsed position 170, the raised position 172, or a desired intermediate position between the collapsed position 170 and the raised position 172.

In some embodiments, the controller 204 is separate from the blower 202 (as illustrated) and may be positioned adjacent a patient support apparatus. In other embodiments, the controller 204 may be incorporated into a housing of the blower 202. In yet another embodiment, the controller 204 may be a pendant that a user can operate while positioned on a patient support apparatus. Accordingly, the user may adjust a height of the center panel 122 while positioned on the patient support apparatus and supported by the head elevation apparatus 100.

Figure 4:
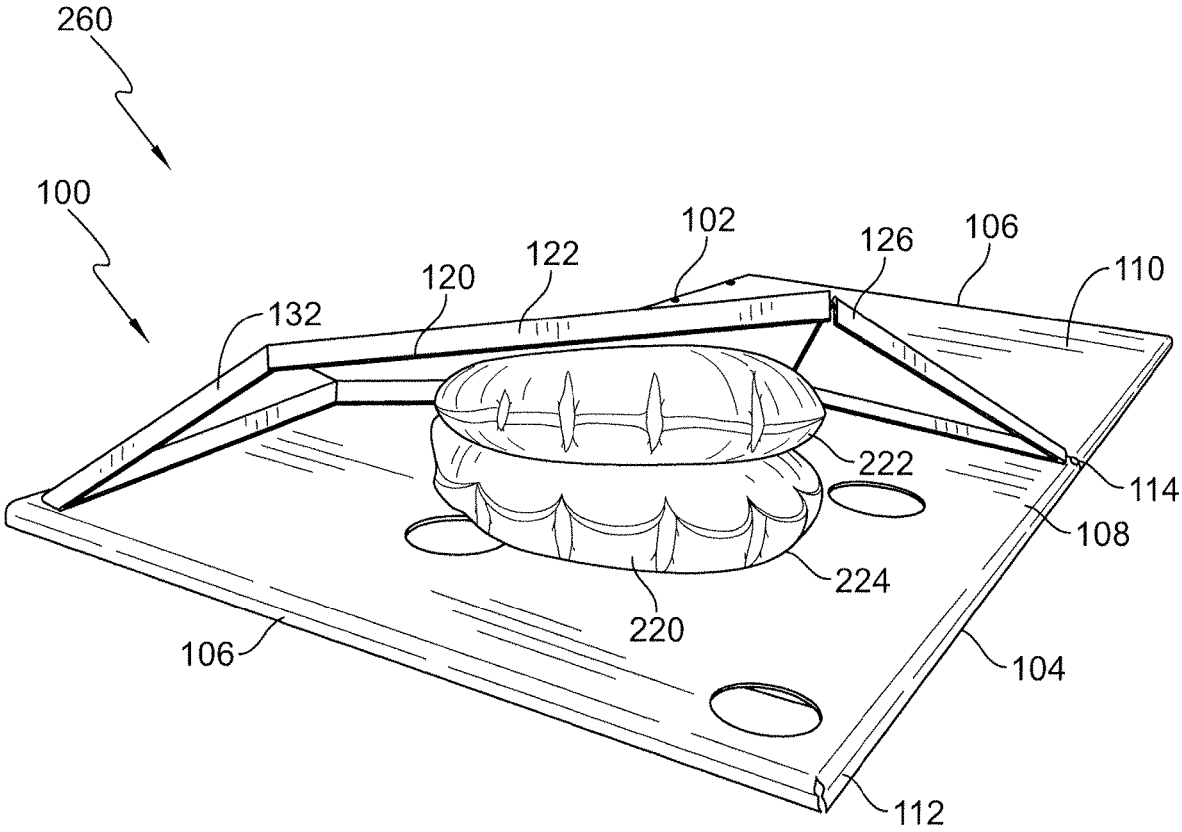
FIG. 4 is a rear perspective view of the head elevation apparatus, wherein a center panel is raised to the raised position by a bladder and an upper flap and a lower flap are folded inward toward the center panel.

Referring to FIG. 4, a bladder 220 is positioned between the base panel 108 and the top panel 120. The bladder 220 extends between the base panel 108 and the center panel 122. The bladder 220 is illustrated with an upper bladder 222 and a lower bladder 224. The upper bladder 222 is positioned above the lower bladder 224. The upper bladder 222 and the lower bladder 224 are in fluid communication. The combination of the upper bladder 222 and the lower bladder 224 facilitates balancing the center panel 122 on the bladder 220. It should be noted that the bladder 220 may include any number of bladder sections, including only one bladder section. The upper bladder 222 is positioned adjacent to and in contact with the center panel 122. The lower bladder 224 is positioned adjacent to and in contact with the base panel 108.

As the bladder 220 is inflated, the center panel 122 raises relative to the base panel 108. The bladder 220 may be inflated to any desired pressure to raise the center panel 122 to a desired intermediate position between the collapsed position 170 and the raised position 172. As illustrated in FIG. 3, when the center panel 122 is raised, the upper flap 126 is rotated inward. Likewise, the lower flap 132 is rotated inward when the center panel 122 is raised. In some embodiments, at least one of the upper flap 126 and the lower flap 132 may rotate into contact with the bladder 220 to inhibit further inward movement of the upper flap 126 and the lower flap 132. However, as illustrated in FIG. 3, the upper flap 126 and the lower flap 132 do not need to contact the bladder 220 to maintain a respective position of the upper flap 126 and the lower flap 132.

FIG. 4 illustrates a single bladder 220 configured to raise and lower the center panel 122. It will be appreciated that the apparatus 100 may include any number of bladders 220 to raise and lower the center panel 122. For example, an array of bladders 220 may be configured to raise and lower the center panel 122. In such an embodiment, each bladder 220 of the array of bladders 220 may be inflated to a different pressure to balance the center panel 122. In other embodiments, an actuator other than the bladder 220 may be utilized to raise and lower the center panel 122. For example, the center panel 122 may be raised and lowered by a hydraulic mechanism.

Figure 5:
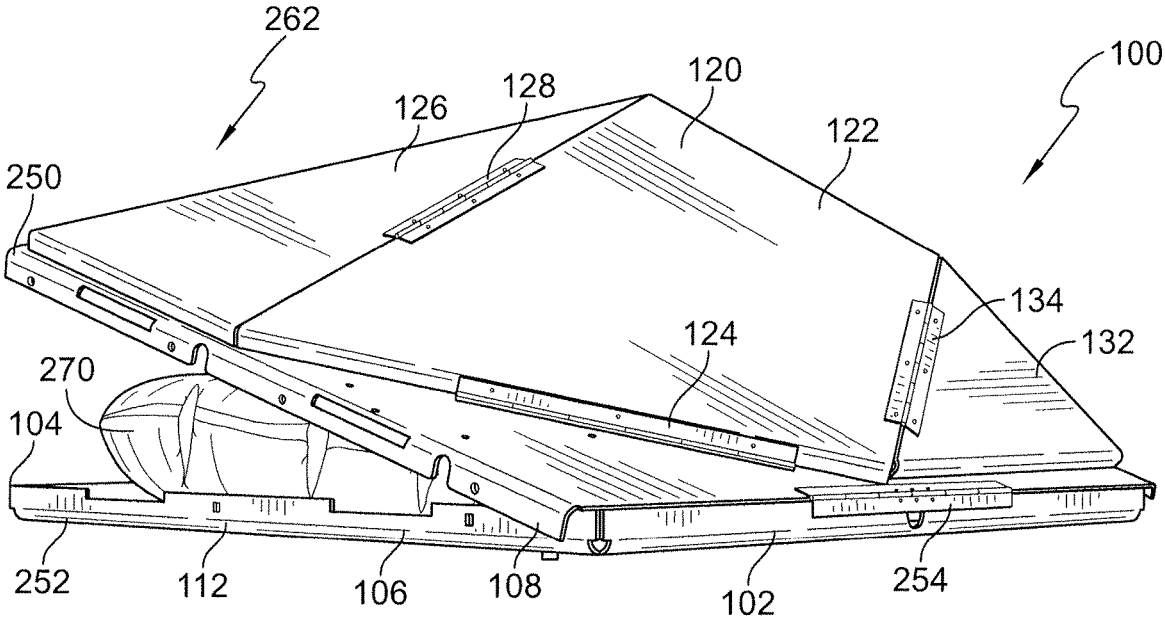
FIG. 5 is a side perspective view of the head elevation apparatus showing the top panel raised relative to the base panel by the bladder and an upper panel of the base panel raised relative to a lower panel of the base panel by another bladder.

Referring to FIG. 5, in some embodiments, the base panel 108 includes an upper panel 250 and a lower panel 252. The upper panel 250 is hingedly attached to the lower panel 252 along a base hinge 254 that extends along the front end 102. The center hinge 124 extends at the oblique angle 150 relative to the base hinge 254. The upper hinge 128 extends at the oblique angle 152 relative to the base hinge 254. The lower hinge 134 extends at the oblique angle 156 relative to the base hinge 254.

The upper panel 250 may be raised and lowered between a retracted position 260 (shown in FIGS. 1-4) and an extended position 262 (shown in FIGS. 5-8) relative to the lower panel 252. A bladder 270 is positioned between the upper panel 250 and the lower panel 252. The bladder 270 is inflated and deflated to raise and lower the upper panel 250 between the retracted position 260 and the extended position 262. The bladder 270 may also be inflated and deflated to a pressure that positions the upper panel 250 at an intermediate position between the retracted position 260 and the extended position 262. The bladder 270 may be inflated and deflated by the blower 202. That is the blower 202 may inflate and deflate the bladder 270 and the bladder 220 simultaneously. Optionally, a valve (not shown) may be provided to directed airflow from the blower 202 to one of the bladder 270 or the bladder 220. In some embodiments, the apparatus 100 may include two blowers 202, wherein each blower 202 operates one of the bladders 220 and 270. The controller 204 may be utilized to control the inflation and deflation of each of the bladders 220 and 270. The bladder 270 is illustrated as having a single section; however, the bladder 270 may include any number of sections.

Figure 6:
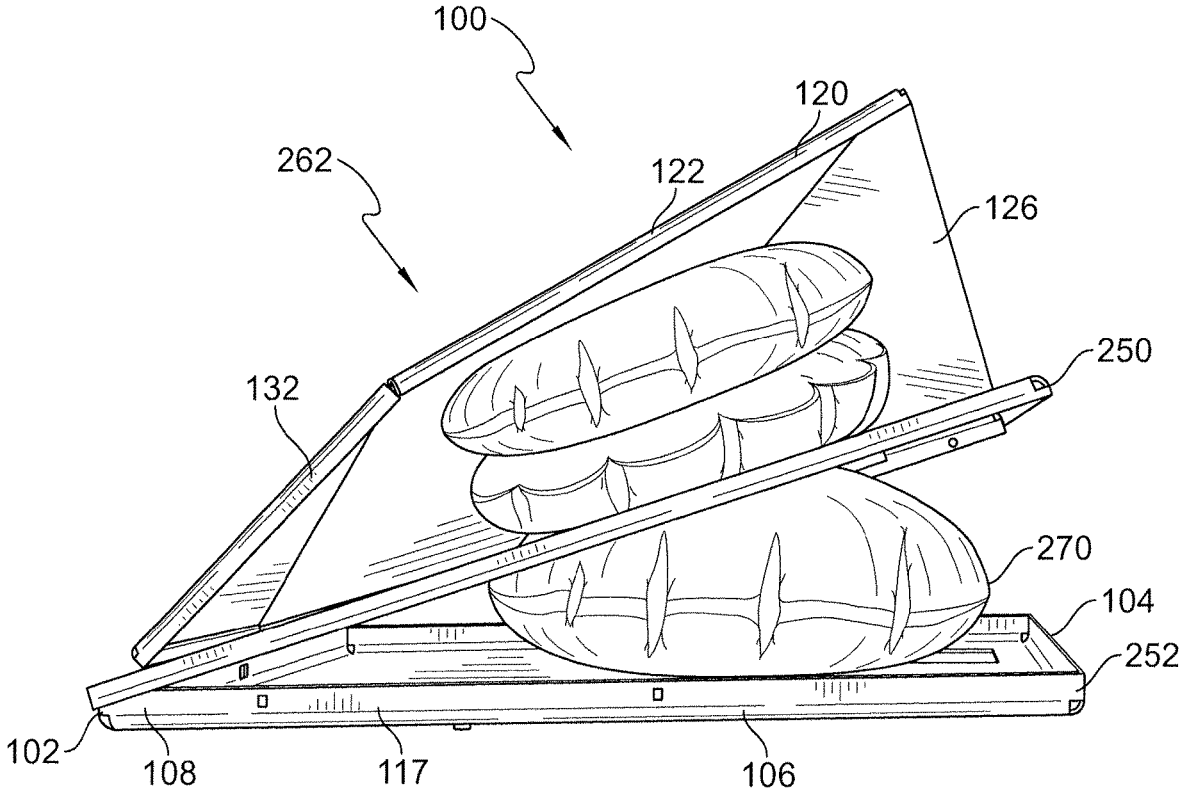
FIG. 6 is an opposite side perspective view of the head elevation apparatus showing the top panel raised relative to the base panel by the bladder and the upper panel of the base panel raised relative to the lower panel of the base panel by the other bladder.

As illustrated in FIG. 6, both bladders 220 and 270 may be operated at the same time. That is, the bladder 220 may be inflated to raise the center panel 122, while the bladder 270 is operated to raise the upper panel 250. The center panel 122 is raised and lowered to alter a lateral angle of the apparatus 100, whereas the upper panel 250 is raised and lowered to alter a longitudinal angle of the apparatus 100. By adjusting the bladder 220 and the bladder 270 at the same time, both the lateral angle and the longitudinal angle of the apparatus 100 are adjusted. However, the bladder 220 may be adjusted alone to adjust only the lateral angle. Likewise, the bladder 270 may be adjusted alone to alter only the longitudinal angle. When operating the apparatus 100, both the bladder 220 and the bladder 270 may be inflated or deflated to different intermediate positions to provide a desired lateral angle and a desired longitudinal angle.

Figure 7:
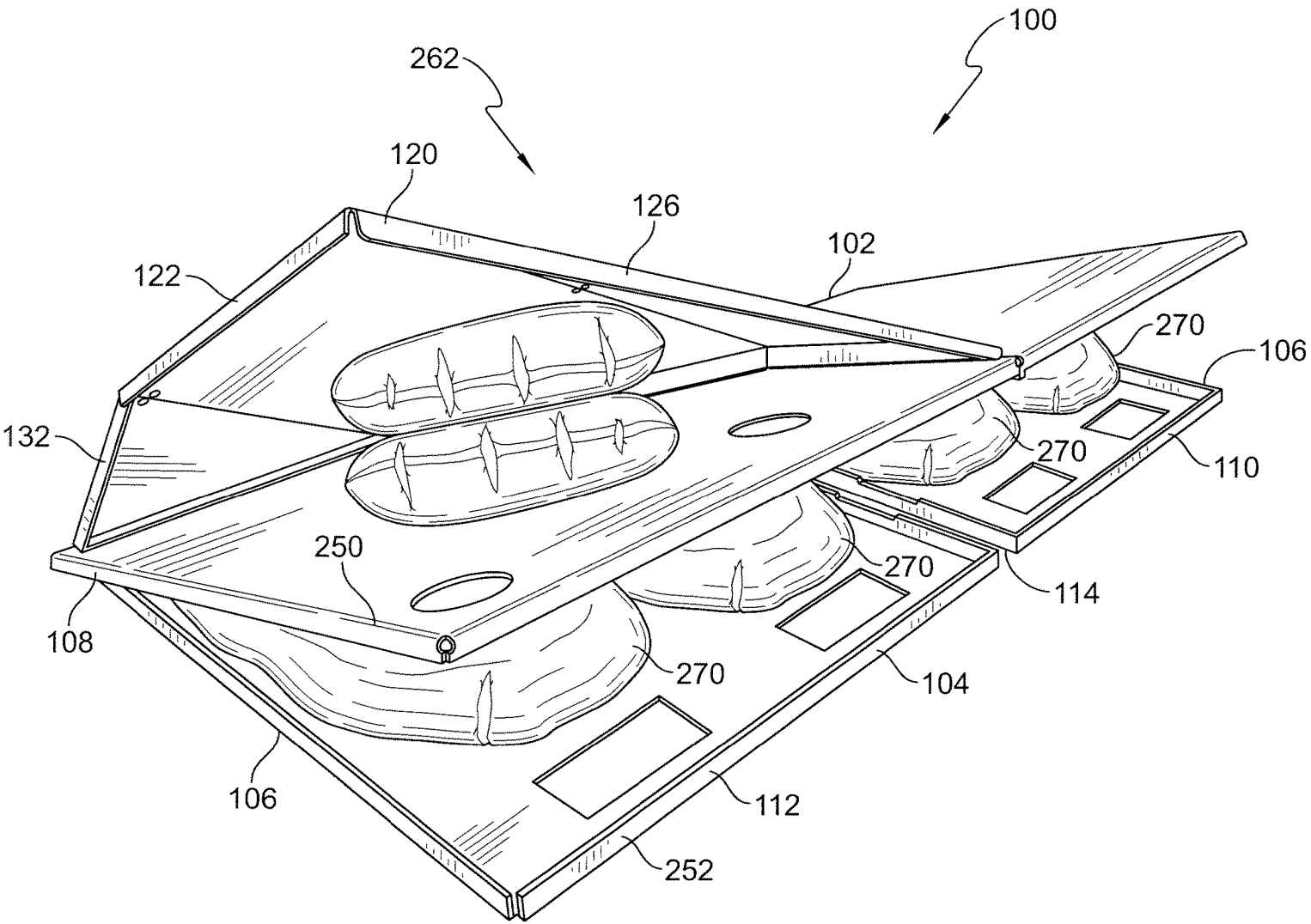
FIG. 7 is a rear perspective view of the head elevation apparatus showing the top panel raised relative to the base panel by the bladder and the upper panel of the base panel raised relative to the lower panel of the base panel by the other bladder.

Referring to FIG. 7, the apparatus 100 includes two bladders 270 on the right side 112 and two bladders 270 on the left side 110. Accordingly, each of the sides 112 and 110 of the apparatus 100 may be raised and lowered. Notably, each side 110 and 112 may include any number of bladders 270, for example one. As illustrated, the bladders 270 may all be adjusted to alter a longitudinal angle of both sides 110 and 112. Additionally, the right side 112 also includes the top panel 120. The center panel 122 of the top panel 120 may also be raised and lowered to alter the lateral angle of the right side 112.

Figure 8:
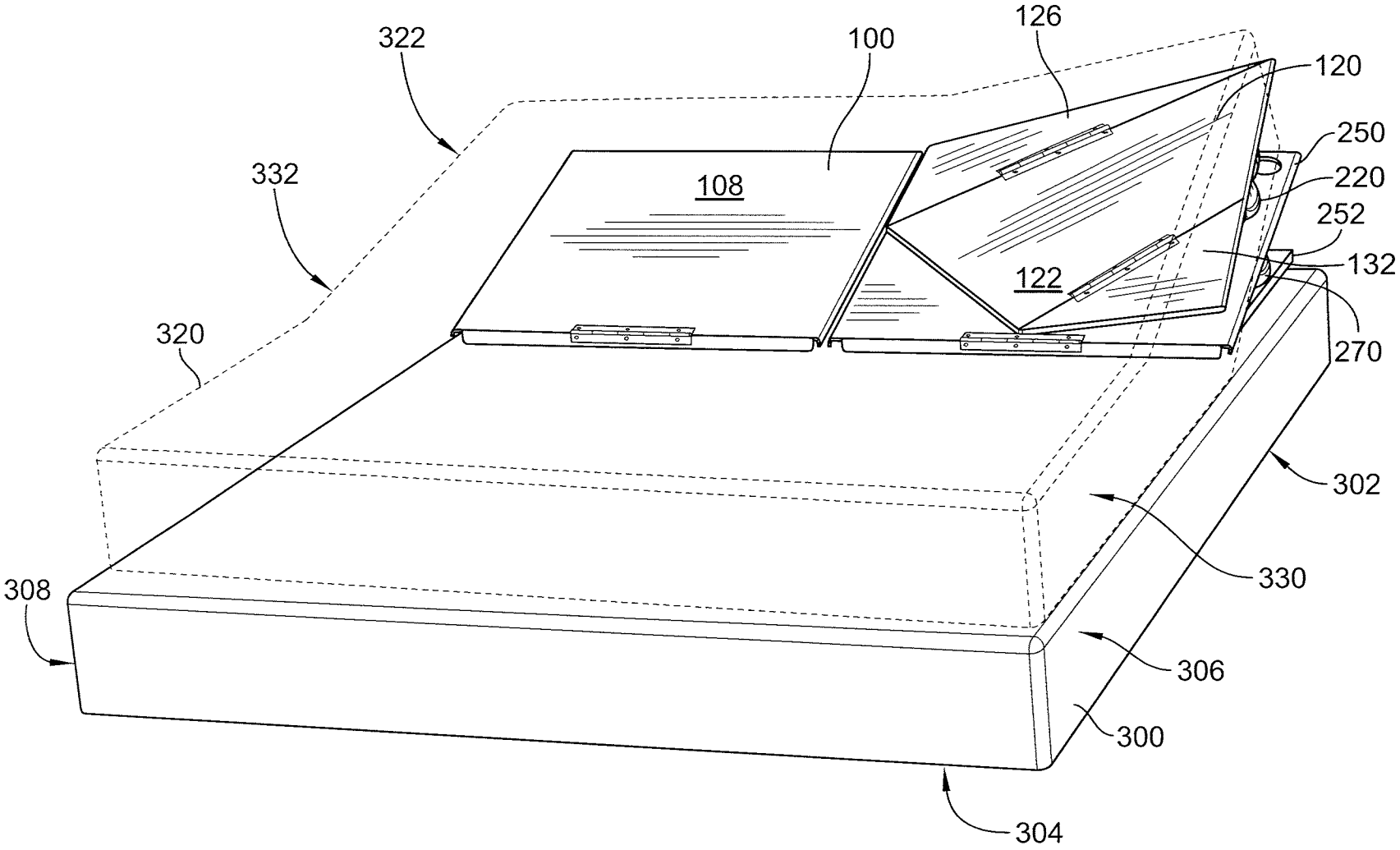
FIG. 8 is a front perspective view of the head elevation apparatus in a raised position to alter a lateral and longitudinal angle of a mattress positioned over a patient support apparatus.

FIG. 8 illustrates a patient support apparatus 300 having a head end 302 and a foot end 304. A right side 306 and a left side 308 extend between the head end 302 and the foot end 304. A longitudinal axis 310 (shown in FIG. 3) extends from the head end 302 to the foot end 304. A lateral axis 312 (shown in FIG. 3) extends from the right side 306 to the left side 308. The apparatus 100 is positioned at the head end 302 of the patient support apparatus 300. A mattress 320 having a head end 322 is positioned over the patient support apparatus 300 so that the apparatus 100 is positioned between the head end 302 of the patient support apparatus 300 and the head end 322 of the mattress 320. The head end 322 of the mattress 320 includes a right side 330 and a left side 332. The right side 330 of the mattress 320 is positioned over the right side 112 of the apparatus 100, and the left side 332 of the mattress 320 is positioned over the left side 110 of the apparatus 100.

In the illustrated embodiment, the upper panel 250 is illustrated in the extended position 262 to raise the head end 322 of the mattress 320 and alter a longitudinal angle of the head end 322 of the mattress 320. Also, the center panel 122 is raised to the raised position 172 to alter a lateral angle of the right side 330 of the mattress 320. It should be noted that only the center panel 122 may be raised to the raised position 172 to alter the lateral angle, while the upper panel 250 is in the retracted position 260. Likewise, only the upper panel 250 may be raised to the extended position 262 to alter the longitudinal angle, while the center panel 122 is in the collapsed position 170. As set forth above, both the center panel 122 and the upper panel 250 may be raised or lowered to intermediate positions where in each of the lateral angles and the longitudinal angles are different.

The apparatus 100 provides graduated lateral rotation (GLR) as a therapy for sleep disordered breathing. The apparatus allows GLR to be added to any existing consumer bed that conforms to an adjustable frame (e.g., viscoelastic foam or air bladder) by introducing an adjustable wedge below the mattress in the head and torso sections. The apparatus 100 includes an upper module that creates a lateral angle under the mattress. In another embodiment, the apparatus 100 may also include a lower module to create a longitudinal angle (or "elevated head of bed" position). The upper module can be mounted on the lower module.

The upper module uses a single bladder and a single hinged panel to provide improved comfort by creating a more continuous support of the mattress and reducing variation that could be uncomfortable to users. The apparatus 100 also provides improved mattress wear by supporting the mattress continuously rather than leaving areas of the mattress unsupported, potentially resulting in mattress damage, wear, or breakdown. The lower module supplements the laterally angled surface of the upper module to improved comfort by providing a raised (e.g., 5-15 degree) angle under the laterally angled support. The modular nature of the apparatus 100 also simplifies installation and reduces shipping cost and burden.

Although this disclosure refers to multiple embodiments, it will be appreciated that aspects of each embodiment may be utilized with other embodiments described herein.

Although this disclosure refers to specific embodiments, it will be understood by those skilled in the art that various changes in form and detail may be made without departing from the subject matter set forth in the accompanying claims.

What is claimed is:

1. A head elevation apparatus configured to be positioned under a mattress, the apparatus comprising:

a base panel, a top panel positioned on the base panel, the top panel comprising:

a center panel hingedly coupled to the base panel, an upper flap hingedly coupled to the center panel, and a lower flap hingedly coupled to the center panel, a first bladder positioned between the center panel and the base panel, and an air source coupled to the first bladder to inflate and deflate the first bladder, wherein the center panel is configured to move between a collapsed position and a raised position relative to the base panel when the first bladder is inflated and deflated, and wherein, when the center panel is moved to the raised position, the upper flap and the lower flap rotate relative to the center panel, wherein the center panel is hingedly coupled to the base panel along a center hinge that extends at a first oblique angle relative to a front face of the base panel.

2. The apparatus of claim 1, wherein the upper flap is hingedly coupled to the center panel along an upper hinge that extends at a second oblique angle relative to the front face.

3. The apparatus of claim 2, wherein the upper hinge extends at a third oblique angle relative to the center hinge.

4. The apparatus of claim 1, wherein the lower flap is hingedly coupled to the center panel along a lower hinge that extends at a fourth oblique angle relative to the front face.

5. The apparatus of claim 4, wherein the lower hinge extends at a fifth oblique angle relative to the center hinge.

6. The apparatus of claim 5, wherein the upper flap is hingedly coupled to the center panel along an upper hinge, the lower flap is hingedly coupled to the center panel along a lower hinge, and the lower hinge extends at a sixth oblique angle relative to the upper hinge.

7. The apparatus of claim 1, wherein moving the center panel to the raised position alters a lateral angle of the mattress.

8. The apparatus of claim 7, wherein the center panel is movable to a plurality of intermediate positions between the collapsed position and the raised position, wherein the lateral angle of the mattress is different at each intermediate position.

9. The apparatus of claim 1, wherein the base panel includes a lower panel and an upper panel, the upper panel being hingedly coupled to the lower panel and configured to move between a retracted position and an extended position.

10. The apparatus of claim 9, wherein the upper panel moves to the extended position to alter a longitudinal angle of the mattress.

11. The apparatus of claim 10, wherein the upper panel is movable to a plurality of intermediate positions between the retracted position and the extended position.

12. The apparatus of claim 9, further comprising a second bladder positioned between the upper panel and the lower panel, the second bladder being inflatable and deflatable to move the upper panel between the retracted position and the extended position.

13. The apparatus of claim 1, wherein the air source comprises a blower.

14. A head elevation apparatus configured to be positioned under a mattress, the apparatus comprising:

a base panel, a top panel positioned on the base panel, the top panel comprising:

a center panel hingedly coupled to the base panel, an upper flap hingedly coupled to the center panel, and a lower flap hingedly coupled to the center panel, a first bladder positioned between the center panel and the base panel, and an air source coupled to the first bladder to inflate and deflate the first bladder, wherein the center panel is configured to move between a collapsed position and a raised position relative to the base panel when the first bladder is inflated and deflated, and wherein, when the center panel is moved to the raised position, the upper flap and the lower flap rotate relative to the center panel, wherein moving the center panel to the raised position alters a lateral angle of the mattress.

15. The apparatus of claim 14, wherein the center panel is movable to a plurality of intermediate positions between the collapsed position and the raised position, wherein the lateral angle of the mattress is different at each intermediate position.

16. A head elevation apparatus configured to be positioned under a mattress, the apparatus comprising:

a base panel, a top panel positioned on the base panel, the top panel comprising:

a center panel hingedly coupled to the base panel, an upper flap hingedly coupled to the center panel, and a lower flap hingedly coupled to the center panel, a first bladder positioned between the center panel and the base panel, and an air source coupled to the first bladder to inflate and deflate the first bladder, wherein the center panel is configured to move between a collapsed position and a raised position relative to the base panel when the first bladder is inflated and deflated, wherein, when the center panel is moved to the raised position, the upper flap and the lower flap rotate relative to the center panel, wherein the base panel includes a lower panel and an upper panel, the upper panel being hingedly coupled to the lower panel and configured to move between a retracted position and an extended position, and wherein the upper panel moves to the extended position to alter a longitudinal angle of the mattress.

17. The apparatus of claim 16, wherein the upper panel is movable to a plurality of intermediate positions between the retracted position and the extended position.

* * * * *